US006370837B1

(12) United States Patent
McMahon et al.

(10) Patent No.: US 6,370,837 B1
(45) Date of Patent: Apr. 16, 2002

(54) SYSTEM FOR LAYING MASONRY BLOCKS

(75) Inventors: Anthony Basil McMahon; Patrick James McMahon; Thomas Joseph Noone, all of Palos Heights, IL (US)

(73) Assignee: Anthony B. McMahon, Palos Heights, IL (US)

( * ) Notice: Subject to any disclaimer, the term of this patent is extended or adjusted under 35 U.S.C. 154(b) by 0 days.

(21) Appl. No.: 09/366,972

(22) Filed: Aug. 4, 1999

(51) Int. Cl.[7] ..... E04G 21/14

(52) U.S. Cl. ..... 52/749.14; 52/DIG. 1; 414/10; 414/626; 414/792.9; 156/579; 156/575

(58) Field of Search ..... 52/749.13, 749.14, 52/747.1, DIG. 1; 156/297, 558, 579, 575; 118/315, 411, 412; 222/611.2; 414/10, 626, 792.9

(56) References Cited

U.S. PATENT DOCUMENTS

| | | | | |
|---|---|---|---|---|
| 1,573,263 A | | 2/1926 | Madden | |
| 1,736,812 A | | 11/1929 | Youngblood | |
| 1,764,836 A | | 6/1930 | Guerini | |
| 1,818,741 A | | 8/1931 | Palatini | |
| 2,341,691 A | * | 2/1944 | Ciceske | |
| 2,444,122 A | | 6/1948 | Wahl | 304/29 |

(List continued on next page.)

FOREIGN PATENT DOCUMENTS

| | | |
|---|---|---|
| CA | 975140 | 9/1975 |
| DE | 270180 | 7/1968 |
| DE | 3601404 | 7/1987 |
| FR | 2649741 | 3/1991 |
| NL | 287072 | 2/1965 |
| SU | 1330286 | 8/1987 |

*Primary Examiner*—Blair M. Johnson
(74) *Attorney, Agent, or Firm*—Dick and Harris

(57) ABSTRACT

The present invention is directed to a system and method for laying masonry blocks in multiple block units. The system comprises a mortar injection device, a block hoist apparatus and a mortar applying apparatus, The mortar injection device includes a mortar feed, mortar dispensing chutes and a block tamper. The mortar dispensing chutes are positioned to inject mortar into gaps between adjacent blocks in the multiple block unit, to create a mortar joint between each block. The block tamper comprises a vibratory roller and/or a series of vibrating pistons attached to the mortar injection device, and facilitates substantially uniform settling of the mortar in the block gaps. The block hoist apparatus includes a mechanical hoist, a hoist transmission member, a weight distribution beam, gripping arms pivotally attached to the weight distribution beam, major gripping members associated with each gripping arm and mounted on a gripper mounting bar, at least one minor gripping member also mounted on the gripper mounting bar and digitally spaced from a corresponding major gripping member. At least a portion of each of the major and minor gripping members are insertable into different blocks of a multiple block unit and cooperate, upon lifting of the weight distribution beam by the mechanical hoist, to exert a clamping force along an interior portion of the blocks to retain the blocks in alignment for raising and lowering of the multiple block unit. The mortar applying device includes a mortar applicator, a housing for the mortar applicator, a housing guide and means for controlling the dispensing of mortar onto the top surface of a row of blocks, while substantially limiting application of mortar into the inner cavities of the blocks.

61 Claims, 11 Drawing Sheets

U.S. PATENT DOCUMENTS 2,639,608 A 5/1953 Kirschmann ..... 72/129
2,648,218 A 8/1953 Joseph ..... 72/149
2,652,715 A 9/1953 Looze ..... 72/129
2,657,571 A 11/1953 Looze ..... 72/129
2,818,725 A 1/1958 Joseph ..... 72/129
2,828,618 A 4/1958 Doescher ..... 72/129
3,039,233 A 6/1962 Holmes ..... 50/538
3,129,029 A 4/1964 Ruzza ..... 294/62
3,148,432 A * 9/1964 Garnett, Jr.
3,274,382 A 9/1966 Fattori ..... 240/10.6
3,325,960 A 6/1967 James ..... 52/749
3,371,459 A 3/1968 Thomas et al. ..... 52/749
3,545,159 A * 12/1970 Brewer
3,638,008 A 1/1972 Keller et al. ..... 240/1.35
3,659,392 A 5/1972 Stoltz ..... 52/749
3,757,484 A 9/1973 Williamson et al. ..... 52/749
3,764,222 A * 10/1973 Orthman
3,789,101 A 1/1974 Wright et al. ..... 264/261
3,790,428 A * 2/1974 Lingl
3,804,487 A 4/1974 Mahlein ..... 350/96
3,831,819 A * 8/1974 Bloom
3,834,973 A 9/1974 Kummerow ..... 156/558
3,849,228 A 11/1974 Lingl ..... 156/297
3,950,914 A 4/1976 Lowen ..... 52/749
4,039,250 A 8/1977 Gaertner ..... 350/96 B
4,060,955 A 12/1977 Lachnit ..... 52/749
4,067,766 A 1/1978 Larger ..... 156/297
4,137,060 A 1/1979 Timmermann ..... 65/31
4,168,130 A 9/1979 Barth et al. ..... 404/99
4,245,451 A 1/1981 Taylor-Smith ..... 52/747
4,278,378 A 7/1981 Milholen ..... 414/32
4,320,985 A 3/1982 Kleinemas ..... 404/99
4,352,445 A * 10/1982 Cusumano et al.
4,496,211 A 1/1985 Daniel ..... 350/96.2
4,707,056 A 11/1987 Bittner ..... 350/96.12
4,727,457 A 2/1988 Thillays ..... 362/32
4,747,030 A 5/1988 Offner et al. ..... 362/302
4,752,108 A 6/1988 Vollmer ..... 350/96.12
4,786,131 A 11/1988 Mahapatra et al. ..... 350/96.16
4,832,428 A 5/1989 Miyawaki et al. ..... 350/96.11
4,902,093 A 2/1990 Bowen ..... 350/96.2
5,011,253 A 4/1991 Olsen ..... 350/96.18
5,136,475 A 8/1992 McDermott ..... 362/158
5,151,679 A 9/1992 Dimmick ..... 340/326
5,164,945 A 11/1992 Long et al. ..... 372/6
5,169,677 A 12/1992 Sangyoji et al. ..... 427/581
5,170,448 A 12/1992 Ackley et al. ..... 385/31
5,185,828 A 2/1993 van del Tol ..... 385/28
5,193,723 A * 3/1993 Everett et al.
5,284,000 A 2/1994 Milne et al. ..... 52/749
5,301,090 A 4/1994 Hed ..... 362/32
5,369,717 A 11/1994 Attridge ..... 385/12
5,436,971 A 7/1995 Armbrust et al. ..... 380/23
5,527,145 A 6/1996 Duncan ..... 414/486
5,539,577 A 7/1996 Si et al. ..... 359/629
5,638,480 A 6/1997 Ishiharada et al. ..... 385/125
5,771,322 A 6/1998 Matsumoto et al. ..... 385/31
5,790,726 A 8/1998 Ito et al. ..... 385/37
5,872,883 A 2/1999 Ohba et al. ..... 385/129

* cited by examiner

Fig 2
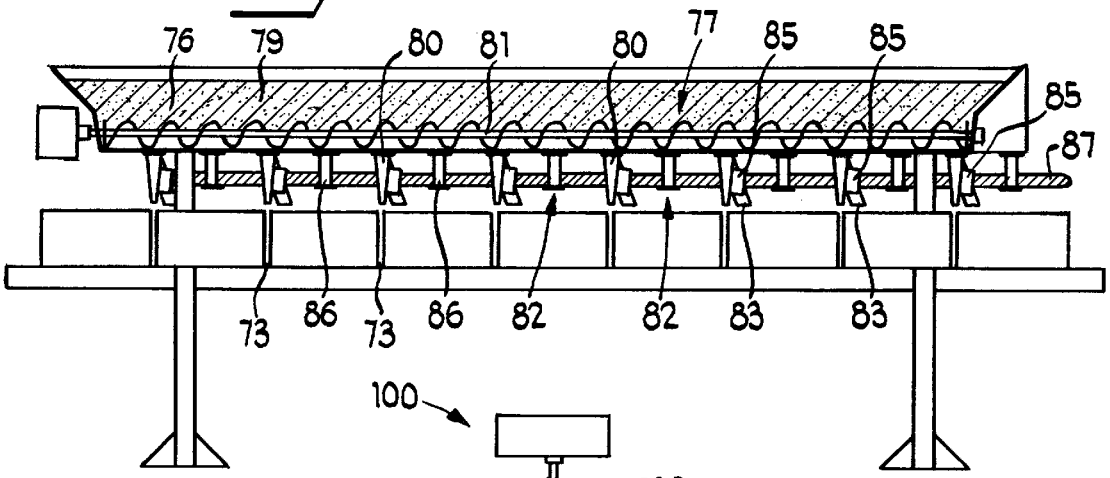
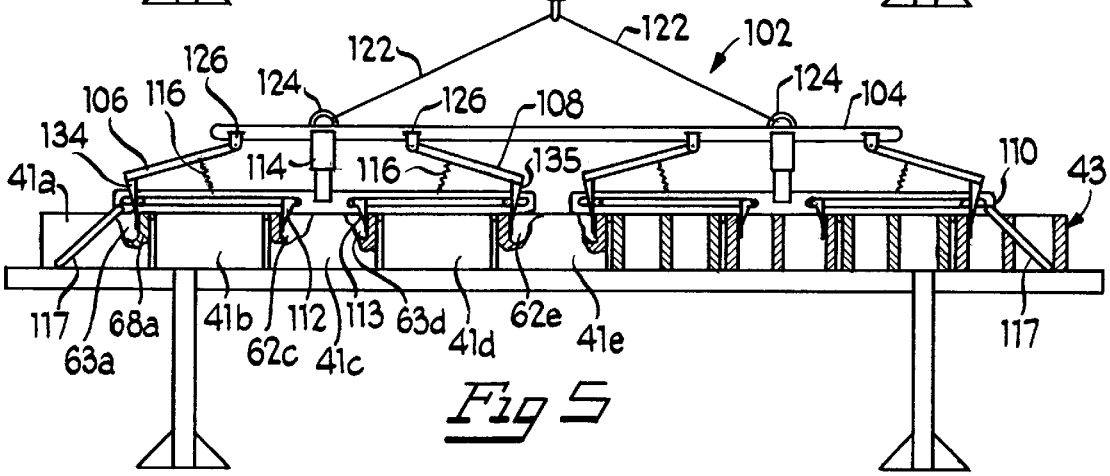
Fig 5
Fig 7
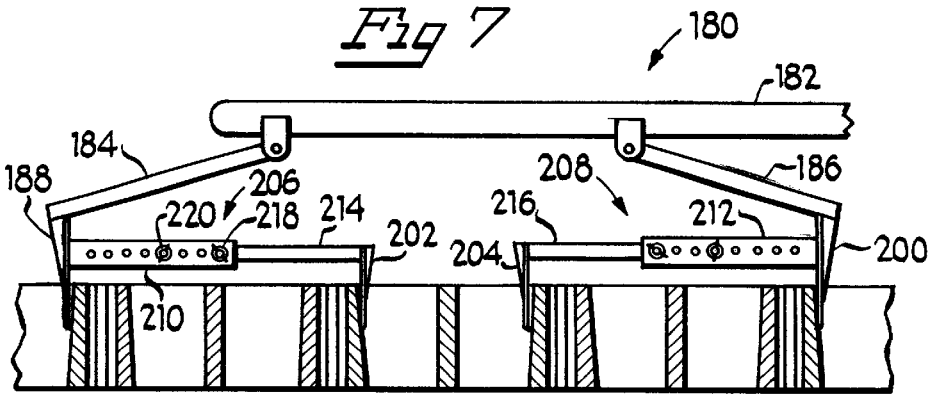

SYSTEM FOR LAYING MASONRY BLOCKS

BACKGROUND OF THE INVENTION

1. Field of the Invention

The present invention relates in general to a system for laying masonry blocks and, more particularly, to a system and its components for laying masonry blocks in multiple-block units.

2. Background Art

Systems for hoisting and laying masonry and other building block have been known in the art for years. Some of these systems have incorporated various block hoisting devices. In particular, early block hoisting devices typically operated by placing one block at a time, by hand or via a mechanical block gripping jaw, onto a previously mortared row of blocks. By limiting the capacity of the device to one block at a time, a hoist system could achieve block placement accuracy, and eliminate the inconvenience and difficulties caused by heavy and bulky multiple block loads. At the same time, however, single-block hoists made the block laying process more time consuming and inefficient. Specifically, not only did such devices mandate a large number of individual block hoisting and laying steps, but such devices also required each block to be mortared after positioning in or on a wall.

Accordingly, hoisting devices were developed to raise, lower and even transport concrete and other building blocks in multiple block units with the use of an overhead hoist. A number of these multiple block hoisting devices consist of lifting tongs, which utilize a scissors-type clamping mechanism, and an underlying block support. While such devices help bear the weight of the blocks, the underlying supports prevent placement of the blocks onto a previously mortared row. Moreover, underlying block supports also limit the ability of the hoist to fit under blocks already positioned on a flat surface, such as a conveyor belt.

Still other of these multiple block hoisting devices include outer clamping jaws extending from a beam to secure the outermost blocks of a multiple block unit. In particular, upon lifting of such hoisting devices, the weight of the blocks prompts the clamping jaws to exert a force inwardly on blocks. Inasmuch as each block is in frictional engagement with an adjacent block, the blocks may be raised and transported in multiple block units. The beam often assists in distributing the weight of the blocks.

While such hoisting devices have worked well to increase block laying efficiency, they are limited by not only the weight of the individual blocks, but also by the number of blocks being lifted. Specifically, although the clamping jaw generally exert an inward clamping force on the outer blocks of the multiple block row, that clamping force diminishes toward the inner-most blocks in the multiple block unit. Thus, the block-to-block friction will not support particularly heavy block loads or long chains of blocks, thus resulting in block fallout or misalignment. Moreover, to the extent that such devices rely on block-to-block friction to maintain the blocks in a multiple block unit, creation of mortar joints between the blocks before hoisting is likewise made difficult.

Moreover, the outer clamping jaws tend to interfere with placement of the multiple block unit in a constrained area. Specifically, the clamping jaws prevent a multiple block unit from being positioned on top of a previously mortared row of blocks when placement must be adjacent to any other blocks. Likewise, the clamping jaws prevent placement of the multiple block unit in any position with a higher wall or other structure adjacent to the block placement target area.

Block hoisting and laying systems have also included devices for applying mortar to a row of blocks or bricks. Mortar laying devices typically include a guide to maintain alignment of the device over a row of blocks, and a mortar applicator for applying a coat of mortar to the top surface of the block row. In particular, the applicator is generally a chute or other opening to permit the flow of mortar therefrom, over the entire top surface of the blocks or bricks. The thickness of the mortar layer in these devices is typically controlled by the size of the applicator opening, the viscosity of the mortar, and/or the rate of movement of the mortar applying device over the block surface.

While these and other mortar laying devices have worked well when used in association with blocks or bricks without inner cavities, they have failed to provide for selectively limiting mortar application to certain regions of the block or brick surface. In particular, it is desirable to control the flow of mortar from the mortar applicator to avoid applying mortar into void regions, such as block cavities, where serves no purpose.

Accordingly, it is a goal in the art to provide a multiple block laying system which incorporates a multiple block hoist apparatus capable of handling any number of blocks, independent of block size, shape and weight. Moreover, it is also desirous to provide a block hoist apparatus which grips the inside of the block cavities to avoid obstacles or impediments to placing a multiple block unit on a desired target area. Likewise, it is a goal to provide a block hoist which exerts a gripping force either directly to or proximate to each block, to ensure that the multiple block unit remains integral and aligned during raising, lowering and transportation thereof.

Moreover, it is a goal in the art to provide a multiple block laying system which incorporates a mortar laying apparatus that selectively controls the dispensing of mortar onto the top surface of a row of blocks—to not only facilitate selective application of mortar onto any top surface configuration, but to also substantially limit application of mortar into inner cavities of blocks.

SUMMARY OF THE INVENTION

The present invention is directed to a system and method for laying masonry blocks in multiple block units. The system comprises a mortar injection device, a block hoist apparatus and a mortar applying apparatus. The mortar injection device includes a mortar feed, mortar dispensing chutes, sliding shut-off gates and a vibrating block tamper. In a preferred embodiment, the mortar feed comprises a pressure pump for delivering mortar to the dispensing chutes. In another preferred embodiment, the mortar feed comprises a motor driven auger.

The mortar dispensing chutes are positioned to inject mortar into gaps between adjacent blocks in the multiple block unit, to create a mortar joint between each block. Each chute is preferably equipped with a sliding shut-off gate to control the flow of mortar from the dispensing chutes.

In one preferred embodiment, the block tamper comprises a vibratory roller positioned at the end of the mortar injection device, and facilitates substantially uniform settling of the mortar in the block gaps. In another preferred embodiment, the block tamper comprises a series of vibratory pistons positioned between each mortar dispensing chute and preferably aligned with the block gap spacing in a multiple block unit.

The block hoist apparatus includes a mechanical hoist, a hoist transmission member, a weight distribution beam, gripping arms pivotally attached to the weight distribution beam, major gripping members and minor gripping members. The mechanical hoist raises and lowers a multiple block unit, and preferably moves laterally for displacement of the multiple block unit.

The hoist transmission member connects the hoist to the weight distribution beam. In a preferred embodiment, the hoist transmission member comprises cables extending from the mechanical hoist to hooks associated with the weight distribution beam.

At a first end, the gripping arms are pivotally attached to the weight distribution beam, and preferably extend downwardly at an angle therefrom. In a preferred embodiment, the gripping arms are attached to a swivel joint associated with the weight distribution beam. The swivel joint is preferably mounted in a slot in the weight distribution beam, to allow slidable movement of the gripping arms relative to the weight distribution beam for minor adjustments in gripper arm positioning.

At a second end, the gripping arms are associated with major gripping members, which are mounted on the gripper mounting bar. In a preferred embodiment, the major gripping members are pivotally mounted on a float which is slidable in a slot in the gripper mounting bar. In another preferred embodiment, the float includes ports for mounting the major gripping members in different positions to accommodate different block sizes and configurations.

In yet another preferred embodiment, the major gripping members are pivotally mounted directly to the gripper mounting bar. It is likewise contemplated that the gripper mounting bar includes a series of apertures for mounting the major gripping members in adjustable positions relative to the gripper mounting bar.

Minor gripping members are also mounted to the gripper mounting bar. Each minor gripping member opposes and cooperates with a corresponding major gripping member, and is distally spaced from that opposing major gripping member. In one preferred embodiment, each pair of opposing major and minor gripping members are pivotally attached to the float, which is slidably adjustable in the slot in the gripper mounting bar. In another preferred embodiment, each pair of major and minor gripping members are mounted directly to the gripper mounting bar. In either case, it is contemplated that the major and minor gripping members may be adjusted along the length of the gripper mounting bar.

Each of the major and minor gripping members preferably includes a gripping face with grip enhancer. In a preferred embodiment, the grip enhancer includes a claw at the bottom of the major gripping members. In another preferred embodiment, the grip enhancer includes spikes, protrusions or corrugations on the gripping face.

Each of the major and minor gripping members are positionable into different block cavities and cooperate, upon lifting of the weight distribution beam by the mechanical hoist, to exert a clamping force along an interior portion of the blocks to retain the blocks in alignment for raising and lowering of the multiple block unit.

In another preferred embodiment, the major and minor gripping members are associated with either end of a telescoping gripper mounting bar. Preferably, the major gripping members are associated with an outer telescoping member, while the minor gripping members are associated with an inner telescoping member. The inner and outer telescoping members are adjustable relative to one another to alter the distance between the gripping surfaces on the respective major and minor gripping members, and may be locked before lifting of the apparatus.

In yet another embodiment, the gripping arms all extend downward from the weight distribution beam at substantially the same angle. Thus, each gripping arm, major gripping member and minor gripping member unit is oriented in substantially the same direction. Lifting of the weight distribution beam still transforms each gripping arm into a lever arm, and creates a clamping force along the interior portion of the inner cavity of the blocks positioned between each set of opposing major and minor gripping members.

In still another preferred embodiment, the block hoist apparatus includes a weight distribution beam, a gripper mounting bar, a first major gripping member, a second major gripping member, a first series of minor gripping members, a second series of minor gripping members, and first and second connecting rails. Each major gripping member is attached to not only the gripper mounting bar, but also to the respective first and second connecting rails. Likewise, each first series and second series of minor gripping members is likewise connected to both the gripper mounting bar and the respective first and second connecting rails. Preferably, the first and second series of gripping members, along with their corresponding major gripping members, face opposite directions. Thus, upon positioning of the gripping members in the blocks in the multiple block unit, and upon subsequent lifting of the weight distribution beam, the first major and first series of minor gripping members act in combination with the opposing second major and second series of minor gripping members to exert a clamping force on the interior portion of the center web of each block in the multiple block unit to retain the blocks in alignment for lowering and raising of the multiple block unit.

The mortar applying device includes a mortar applicator, a housing for the mortar applicator, a housing guide and means for controlling the dispensing of mortar onto the top surface of a row of blocks. The housing preferably includes a mortar distribution chamber divided into multiple channels and outer ports to control dispensing of the mortar onto specific portions of the top surface of the row of blocks.

The housing guide preferably comprises a series of wheels attached to the outside of the housing. In a preferred embodiment, the wheels each include a groove positioned in the outer wheel surface to simultaneously traverse a portion of the top surface and a portion of the side surface of the row of blocks. Additionally, the housing preferably includes a handle to permit manual manipulation and movement of the mortar applying apparatus.

The means for controlling dispensing of mortar include a gate covering a portion of the mortar dispensing port and a sensor to facilitate selective application of mortar onto the top surface of the blocks, while substantially limiting application of mortar into the inner cavities of the blocks. The gate is preferably spring-loaded to remain closed under the weight of mortar.

In one preferred embodiment, the sensor comprises a dip sensor pivotally connected to the gate at one end, and pivotally connected to the housing at the other end. The dip sensor includes a dip portion capable of extending below the top block surface to indicate when the mortar applicator is positioned over a block cavity. Contact of the dip sensor with the top surface of the blocks forces the gate open, thus permitting mortar application onto the top surface of the row of blocks.

In another preferred embodiment, the sensor comprises a laser which likewise determines whether the mortar applicator is positioned over a block surface, or over a block cavity. The laser is part of an electronic circuit which controls opening and closing of the gate.

In yet another preferred embodiment, the mortar applying apparatus may be equipped with a laser sensitive indicator to function in combination with a laser to level the course of the apparatus during mortar application.

BRIEF DESCRIPTION OF THE DRAWINGS

FIG. 2 of the drawings is a front elevational view of the mortar injection device according to one embodiment of the present invention;

FIG. 5 of the drawings is a front elevational view of the block hoist apparatus according to one embodiment of the present invention;

FIG. 7 of the drawings is a front elevational view of the block hoist apparatus according to another embodiment of the present invention;

DETAILED DESCRIPTION OF THE INVENTION

Figure 1:
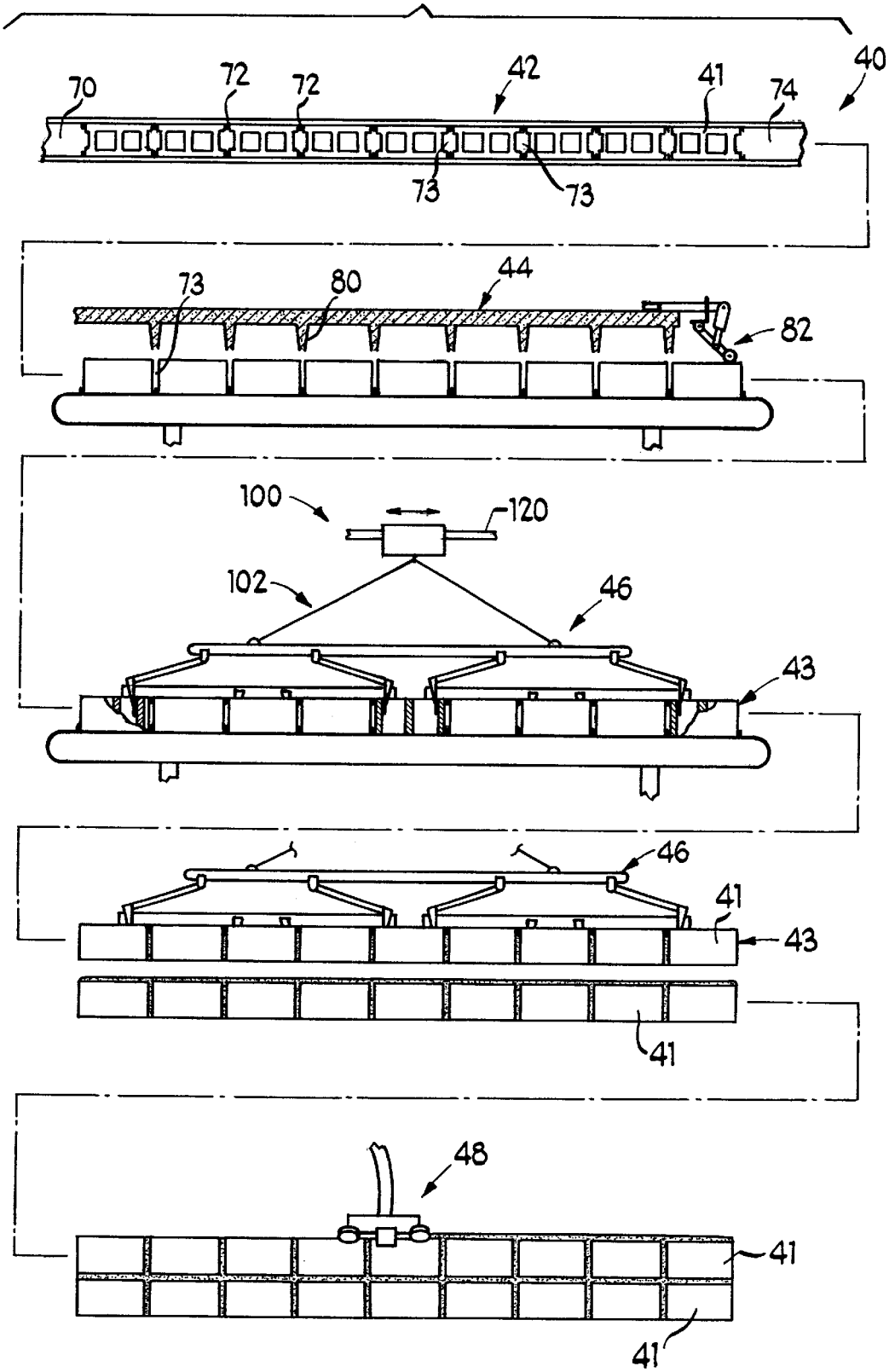
FIG. 1 of the drawings is a schematic view of the system for laying masonry blocks in multiple block units according to the present invention.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Figure 23:
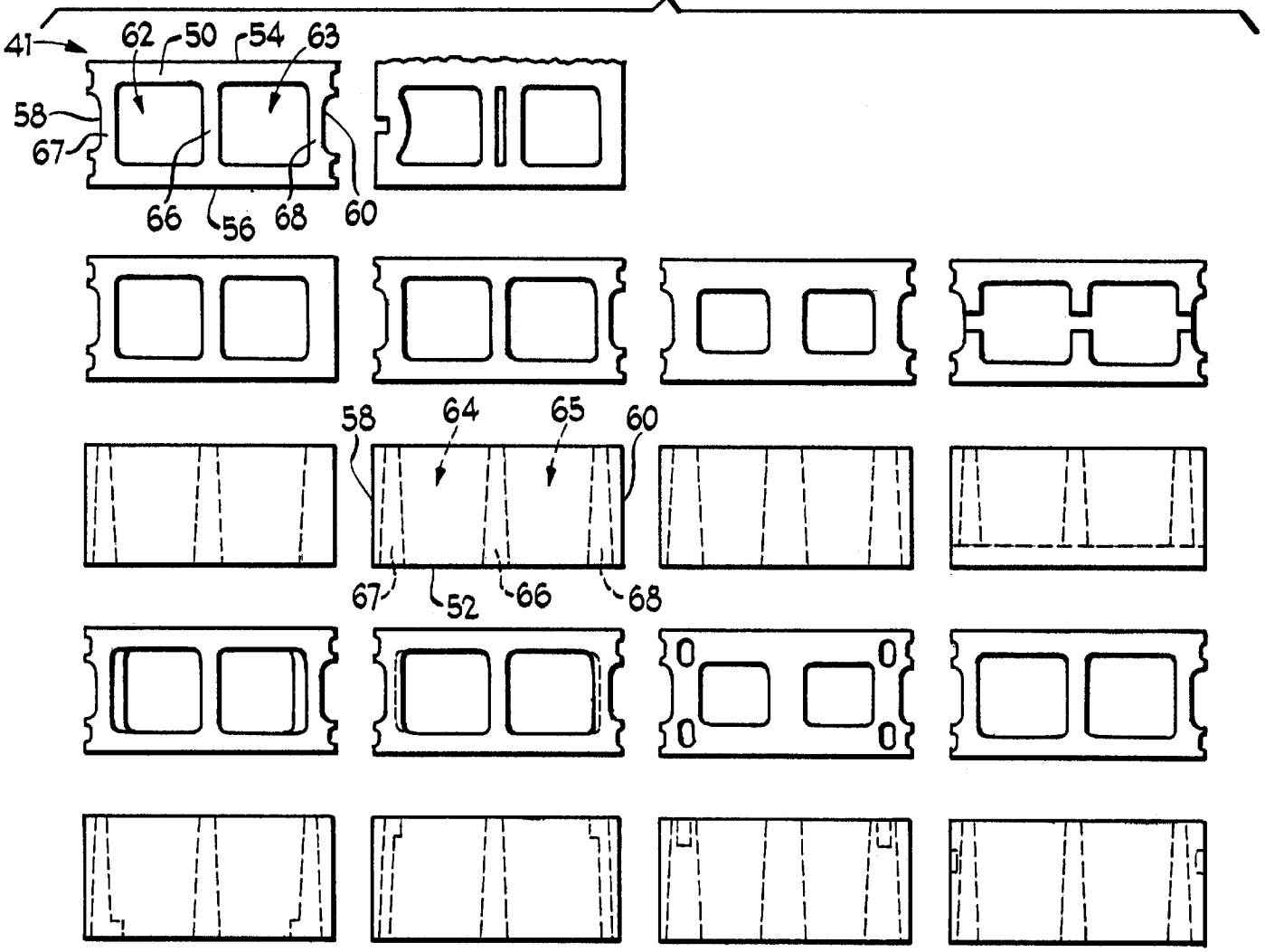
FIG. 23 of the drawings is a top plan and side elevational view of various blocks capable of use with the present invention.

A system 40 for laying masonry blocks 41 in multiple-block units 43 is shown in FIG. 1 as comprising block positioning station 42, mortar injection device 44, block hoist apparatus 46 and a mortar applying apparatus 48. While system 40 is discussed below and shown in specific relation to laying concrete masonry blocks, shown in FIG. 23 as having top surface 50, bottom surface 52, sides 54 and 56, ends 58 and 66, apertures 62 and 63 in the top surface, respective inner cavities 64 and 65 extending into the block from the apertures, center web 66 and end webs 67 and 68, it is contemplated that the current system may used in association with any variety of blocks or bricks. Alternative blocks or bricks may be constructed from any number of materials and may take a wide variety of dimensions and shapes, provided they likewise include at least one aperture and an inner cavity extending into the block or brick. Examples of various concrete block designs are shown in FIG. 23, although other blocks as would be known by those of ordinary skill in the art with the present disclosure before them are likewise contemplated for use with the present invention. Moreover, throughout the description and drawings, like reference numerals will be used for like parts.

Block positioning station 42 comprises conveyor 70 and block spacers 72. Conveyor 70 may comprise any conventional conveyor, and preferably includes a moveable belt 74. Belt 74 may take any width to accommodate the size of the blocks. Spacers 72 are preferably positioned at set intervals on each side of the belt to maintain block spacing and alignment. However, it is likewise contemplated that spacers 72 are positioned on just a single side of the conveyor belt. Preferably, the distance between the spacers may be adjusted to accommodate blocks of varying size. The width of spacers 72 defines block gaps 73 between the blocks.

Likewise, it is contemplated that blocks 41 may be transported to conveyor to a pro-spaced configuration. For instance, the blocks may be palletized at set spacing intervals and then placed on the conveyor at those spaced intervals. In such a case, spacers 72 may not be necessary to establish block spacing. However, the spacers still may be preferred to maintain the appropriate block spacing during injection of mortar between the blocks and subsequent hoisting and transportation of the multiple block units.

Figure 3:
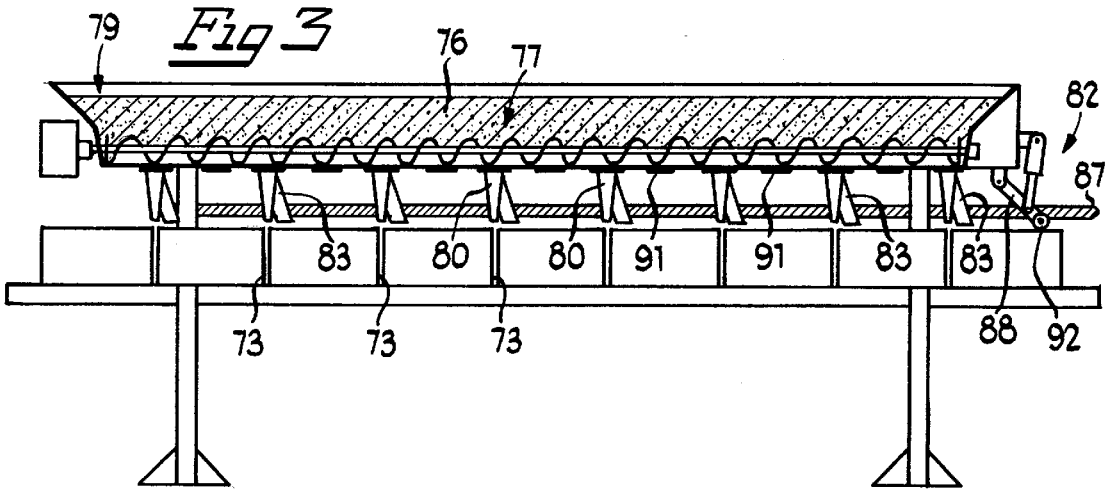
FIG. 3 of the drawings is a front elevational view of the mortar injection device according to another embodiment of the present invention.
Figure 4:
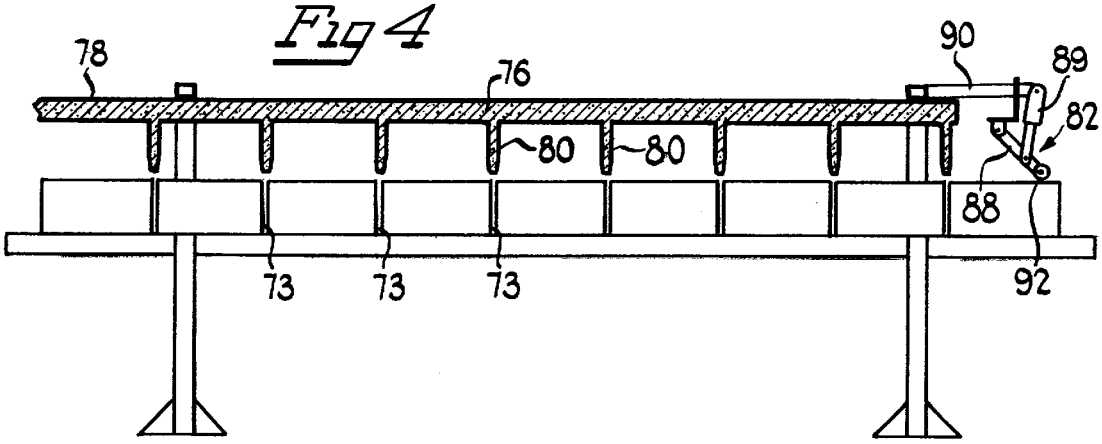
FIG. 4 of the drawings is a front elevational view of the mortar injection device according to yet another embodiment of the present; invention.

Mortar injection device 44, shown in greater detail in FIGS. 2–4, comprises mortar feed 76, mortar dispensing chutes 80, vibrating tamper 82 and sliding shut-off gates 83. In one embodiment, shown in FIGS. 2 and 3, mortar feed 76 comprises an auger feed 77. Auger feed 77 comprises a mortar feed source 79 and a motor-driven auger 81 to funnel the mortar to dispensing chutes 80. In another embodiment, shown in FIG. 4, mortar feed 76 comprises a pump feed 78 which likewise forces the mortar through the dispensing chutes.

Figure 24:
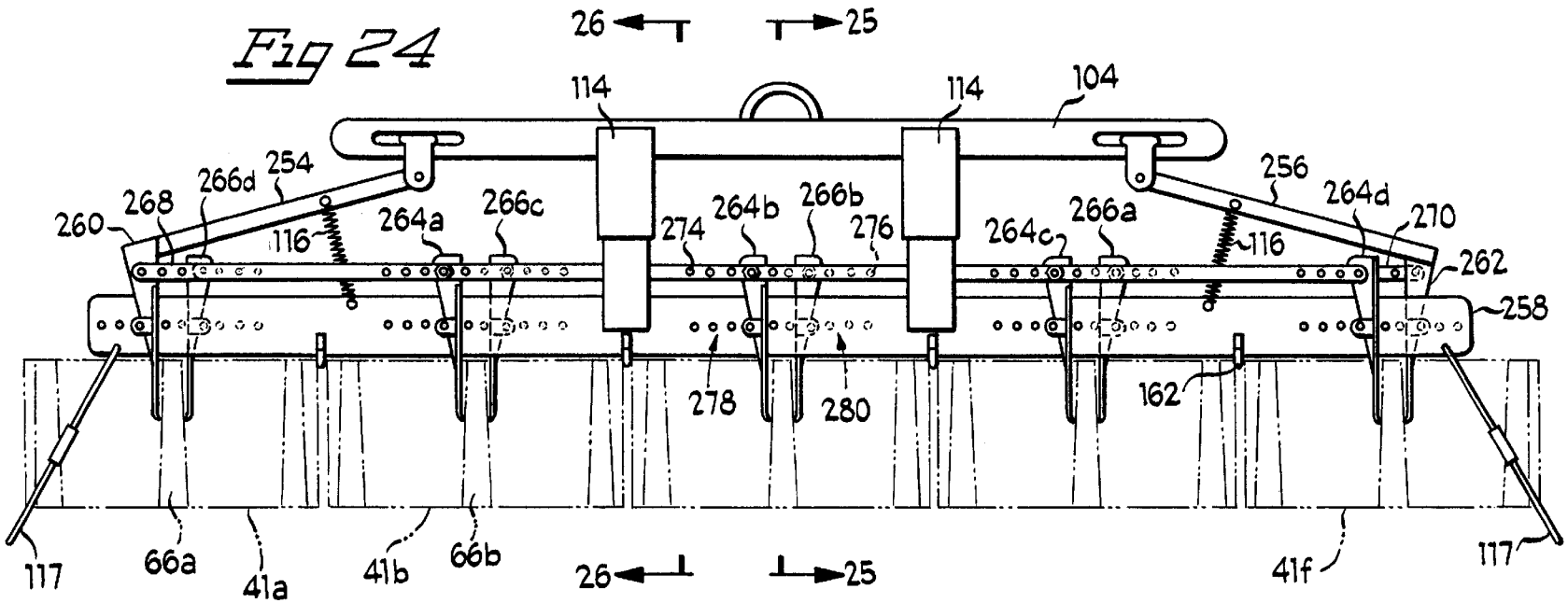
FIG. 24 of the drawings is a side elevational view of another embodiment of the block hoist apparatus shown in FIG. 8.

Dispensing chutes 80 are shown in FIGS. 24 positioned at set intervals corresponding to each block gap 73. Such positioning is preferred to permit chutes 80 to fill each gap 73 with mortar simultaneously while the blocks are positioned under the mortar injection device. Of course, it is likewise contemplated that any number of dispensing chutes may be used, depending on the number of blocks in a multi-block unit and on the corresponding number of block gaps. As will be discussed hereinbelow, the system may be used in association with multiple block units having any number of blocks, depending on the lift capacity of the mechanical hoist.

Moreover, it is also contemplated that mortar injection device 44 is equipped with less dispensing chutes than the number of block gaps associated with each multiple-block unit. For instance, a single chute may be preferred when the size and/or dimensions of any of the blocks in a multiple-block unit varies, thus potentially causing the block gap intervals to likewise vary.

Sliding shut-off gates 83, shown in FIGS. 2 and 3, are preferably associated with each dispensing chute 80. In particular, the sliding shut-off gates are positionable relative to their respective dispensing chutes in two orientations: a first open orientation as shown in the drawings permitting mortar flow through the dispensing chutes and a second closed orientation (not shown) preventing flow of mortar through the dispensing chutes.

A gate control 85, shown in FIG. 2, is preferably associated with each sliding shut-off gate 83 to carry the sliding shut-off gates between the first open orientation and the second closed orientation. The gate control preferably locks the sliding shut-off gates in either orientation. Moreover, it is contemplated that each sliding shut-off gate may be locked in either orientation separately, or preferably in combination with each sliding shut-off gate. In one embodiment, each gate control rides on a hydraulic cylinder. The gate controls may be independent, or act in combination with a rail 89 synchronizing their movement. In another embodiment, shown in FIG. 3, each sliding shut-off gate 80 is attached to a pneumatic bar 87, which opens and closes all of the gates together. In either embodiment where the sliding shut-off gates are connected to act in synchronization, a single user may effect movement of the gates from the open orientation to the closed orientation with relative ease by manipulation of a single rail or bar.

Additionally, a shown in FIG. 3, dispensing chutes 60 may be adjustable along the length of mortar injection device 44 to accommodate blocks of varying length or dimensions, and thus to account for block gaps which are spaced at different intervals. To this end, mortar injection device may be equipped with multiple mortar dispensing ports 91 positioned at set intervals along a track or other chute adjustment mechanism, with each port having a control valve, stopper, plug or other device to prevent mortar flow therefrom when a specific port is not being used for mortar dispensing. Of course, when adjustable, dispensing chutes 80 may be locked in place over a corresponding port.

Moreover, it is further contemplated that mortar injection device 44 is mounted on a hydraulic cylinder (not shown) to facilitate lifting and lowering of dispensing chutes 80. Such a hydraulic capability permits the blocks to be conveyed to a position under the mortar injection device without concern over variation in block height. Dispensing chutes 80 may then be lowered to a position immediately over a corresponding block gap 73 to maximize mortar injection accuracy, and to likewise minimize errant application of mortar onto the top surface of the blocks. Of course, it is also contemplated that dispensing chutes 80 may be removed and replaced by dispensing chutes of differing size and/or length to accommodate blocks of varying size.

In one embodiment, as shown in FIG. 2, vibrating tamper 82 comprises hydraulic tamping pistons 86 attached to mortar injection device 44. Tamping pistons 86 help pack mortar into block gaps 73 to permit substantially uniform distribution of mortar therein. Tamping pistons 86 are preferably positioned between each dispensing chute 80 and spaced at set intervals substantially corresponding to the distance between the block gaps, so as to permit simultaneous tamping of each block joint of the multiple block unit. As will be discussed below, the block gaps are first filled with mortar before they are positioned under the tamping pistons for packing.

In another embodiment, shown in FIGS. 3 and 4, vibrating tamper 82 comprises vibrating roller 88 positioned at the end of mortar injection device 44. The vibrating roller includes hydraulic arm 89, mount 90 and roller 92. Roller 92 vibrates to force settling of the mortar in the block gaps. Hydraulic arm 89 permits roller 92 to adjust to the block surface as the blocks are passed under the vibrating roller. Inasmuch as vibrating roller 88 forces the mortar into the block joints as it passes over those joints, the vibrating roller allows the multiple-block units to be conveyed from the mortar injection device to the block hoist apparatus without intermittent stopping. Of course, it is contemplated that tamping pistons 86 and vibrating roller 88 may be used in combination to maximize uniform distribution of mortar into block gaps 73.

Block hoist apparatus 46, shown in FIGS. 1, 5, 6, 15 and 16, comprises mechanical hoist 100, hoist transmission member 102, weight distribution beam 104, gripping arms 106 and 108, gripper mounting bar 110, major gripping members 134 and 135, minor gripping members 112 and 113, positive lock clamp extender 114, supporting springs 116 and wall feelers 117. Inasmuch as one set of gripping arms, major gripping members and minor gripping members is preferably associated with a single gripper mounting bar, only one set of gripping arms and associated parts will be described with the understanding that such a description applies to each set of gripping arms and each gripper mounting bar. Additionally, while each set of gripping arms is shown associated with a separate gripper mounting bar, it is likewise contemplated that each set of gripping arms is associated with a single gripper mounting bar. Finally, as will become clear with the description to follow, while FIGS. 1 and 5 show two parts of gripping arms associated with the weight distribution beam for hoisting nine blocks, any number of gripping arms may be used to accommodate any odd number of blocks.

Mechanical hoist 100 is shown in FIG. 1 as associated with travel rail 120, and facilitates both the lifting and lowering of multiple block unit 43, while travel rail 120 permits transverse movement of the block hoist apparatus. In particular, mounting of mechanical hoist 100 on travel rail 120 permits transverse movement of the hoist in any plane or direction, as would be known by one of ordinary skill in the art with the present disclosure before them. Thus, multiple block unit may be placed on any pre-selected target, such as another row of blocks. Moreover, while a mechanical hoist is preferred, block hoist apparatus 100 may be used in combination with any non-mechanical or hydraulic hoist.

Hoist transmission member 102 links hoist 100 to weight distribution beam 104. While hoist transmission member 102 preferably comprises cables 122, shown in FIGS. 1 and 5, other transmission members with the strength to support the block hoist apparatus and accompanying blocks are likewise contemplated.

Figure 6:
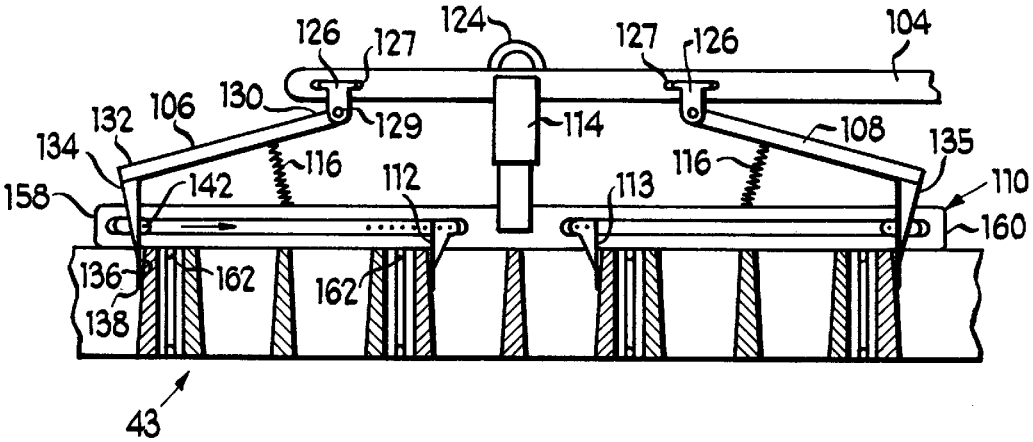
FIG. 6 of the drawings is a front elevational view of the block hoist apparatus of FIG. 5.

Weight distribution beam 104 comprises a substantially horizontal beam with cable hooks 124 and swivel joints 126. Cable hooks 124 are specifically designed to accept cables 122 which attach the block hoist apparatus to the mechanical hoist. Swivel joints 126 extend downwardly from weight distribution beam 104 and pivotally accept gripping arms 106 and 108. Further, as shown in FIG. 6, swivel joints 126 are preferably mounted in slotted regions 127 in weight distribution beam 104 for adjustment of gripping arms 106 and 108 to accommodate variations in block size and dimensions. However, it is likewise contemplated that gripping arms 106 and 108 are attached directly to weight distribution beam 104, for instance by a pivot pin and apertures positioned in the weight distribution.

Additionally, while weight distribution beam 104 is preferably horizontal to distribute the weight of the blocks over the substantial entirety of its length, it is likewise contemplated that the weight distribution beam may also take virtually any form permitting insertion of the gripping members into the blocks of the multiple-block unit.

Gripping arms 106 and 108 are each pivotally attached to weight distribution beam 104, and extend downwardly from the weight distribution beam at an angle. As can be seen from FIGS. 5 and 6, gripping arm 106 extends downwardly from the weight distribution beam at an opposite angle from gripping arm 108, namely a right handed angle versus a left handed angle, to create lever arms for gripping and hoisting multiple block unit 43. Inasmuch as gripping arms 106 and 108 differ only in their angle of descent and the direction faced by their respective major gripping members, only gripping arm 106 will be discussed in detail with the understanding that such a description applies to gripping arm 108.

As shown in FIG. 6, gripping arm 106 comprises first end 130 and second end 132. As discussed above, first end 130 is pivotally attached to weight distribution beam 104 at swivel joint 126 with pivot pin 129. Such pivotal attachment allows gripping arm 106 to pivot freely through a range of positions generally defining the plane occupied by gripping arm 106. Gripping arm 106 extends downwardly from the pivotal attachment and terminates at second end 132, where is it is attached to major gripping member 134.

Major gripping member 134, shown in FIGS. 6, 16, 19 and 20 comprises block gripping surface 136, grip enhancer 138 and pivot receiving member 142. Block gripping surface 196 includes grip enhancer 138, shown in FIG. 16 as taking the form of a claw 140 on the end of major gripping member 134. Claw 140 acts as a pick to firmly secure major gripping member 134 to the inner surface of the interior of a corresponding block. Additionally, it is likewise contemplated that grip enhancer 138 may include spikes, protrusions (FIG. 16) or corrugations (FIG. 17) on block surface 136, in the alternative to or in combination with the claw shown in FIG. 16. Pivot receiving member 142 extends from the block gripping surface 136 and, as discussed below, serves as the point of attachment of major gripping member 134 to gripper mounting bar 110.

Figure 16:
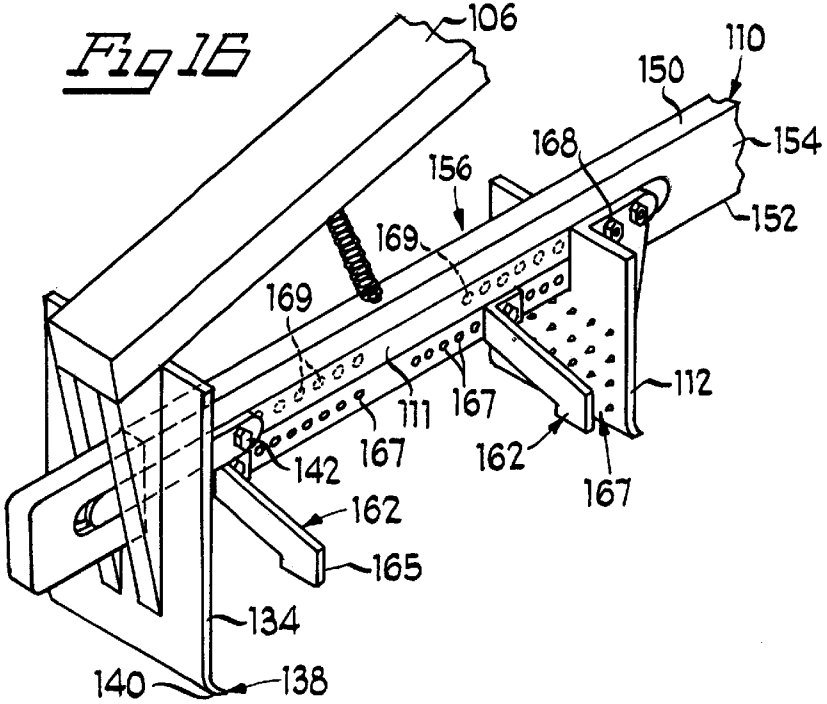
FIG. 16 of the drawings is a perspective view of a portion of the block hoist apparatus shown in FIG. 5.
Figure 19:
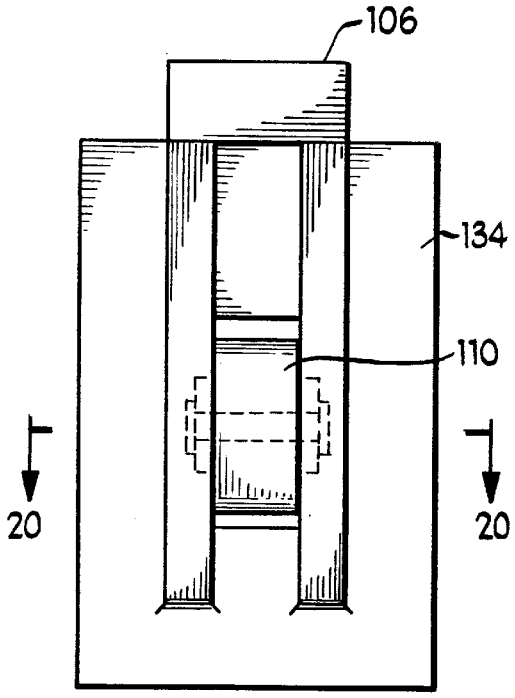
FIG. 19 of the drawings is a side elevational view of the block hoist apparatus shown in FIG. 5.

Minor gripping members 112 and 113, shown in FIGS. 5, 6 and 16, are likewise mounted to gripper mounting bar 110 and oppose corresponding major gripping members 134 and 135. The minor gripping members are distally spaced apart from and cooperate with their corresponding major gripping member. Inasmuch as the minor gripping members are similar except for their direction or orientation, only minor gripping member 112 will be discussed relative to major gripping member 134, with the understanding that the description applies to the structure and relationship of minor gripping member 113 to major gripping member 135.

Minor gripping member 112 comprises block gripping surface 166 and attachment member 168. Block gripping surface 166, like major block gripping member gripping surface 136, preferably includes grip enhancer 167, such as protrusions, spikes or corrugations shown in FIGS. 16 and 17, to better grip the inner surface of a block. The grip enhancement minimizes slippage during lifting and transportation of the multiple block unit. Attachment member 168 extends from minor gripping member 112 and provides a point of attachment to gripper mounting bar 110. Preferably, as shown in FIG. 16, attachment member 168 includes two apertures to accept bolts which lock minor gripping member 112 relative to gripping mounting bar 110 in two locations, to prevent pivotal rotation of the minor gripping member relative to the gripper mounting bar.

Figure 17:
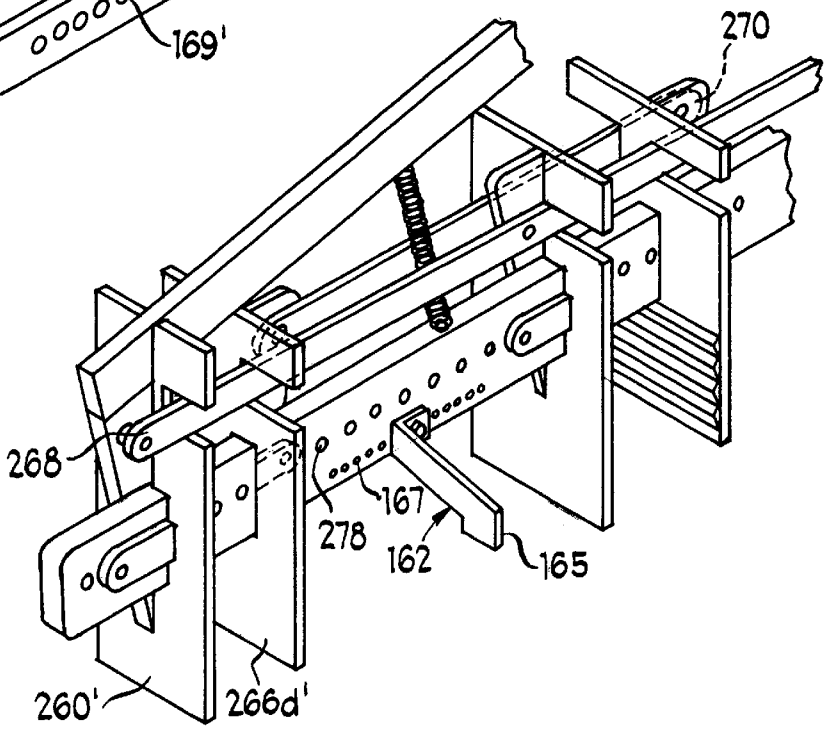
FIG. 17 of the drawings is a perspective view of a portion of one embodiment of the block hoist apparatus shown in FIG. 8.
Figure 26:
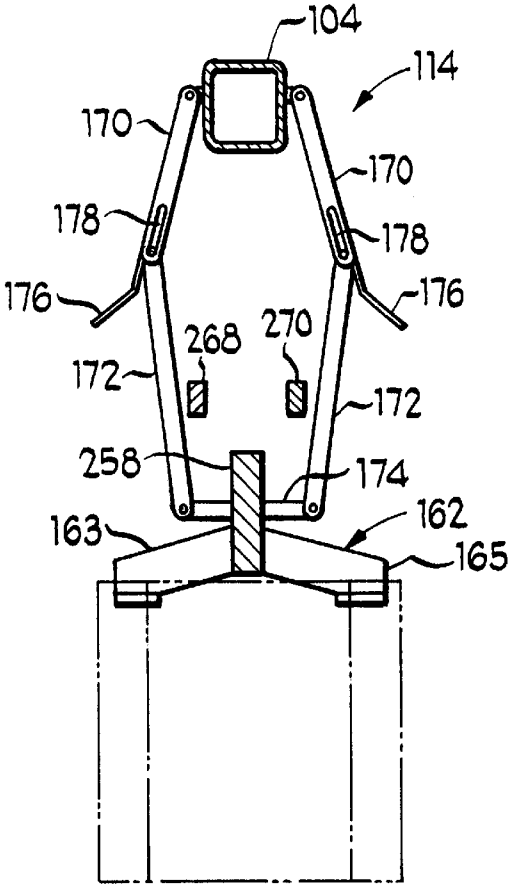
FIG. 26 of the drawings is a guide elevation cross-sectional view of FIG. 24 taken along the lines 26—26.

Gripper mounting bar 110, shown in FIGS. 5, 6, 15 and 16 is positioned below weight distribution beam 104 and includes top surface 150, bottom surface 152, side surfaces 154 and 156, ends 158 and 160, spacers 162, slotted region 164 and float 111. Spacers 162 are shown in FIGS. 16, 17 and 26 as comprising wings 163 and 165 on either side of gripper mounting bar 110. Spacer wings 163 and 165 are attached to side surfaces 154 and 156, respectively, of the gripper mounting bar. While the wings are shown as attached to the gripper mounting bar with bolts, any attachment is likewise contemplated. Moreover, although spacers 162 are shown as including two separate wings, the spacers may be a single, integral piece connected by a bracket extending under the gripper mounting bar.

Further, spacers 162 are preferably adjustable along the length of the gripper mounting bar to accommodate blocks of varying sizes and dimensions. Specifically, blocks of varying dimensions result in block gaps at different intervals, thus requiring spacers 162 to correspond to those intervals. To this end, gripper mounting bar 110 may include apertures 167 on side surfaces 154 and 156, to permit adjustment of spacers 162. Additionally, it is likewise contemplated that spacers 102 are adjustable in width to permit use of the spacers with multiple block units having different block gap widths. Finally, it is likewise contemplated that the spacers extend from bottom surface 152 of gripper mounting bar 110.

As can be seen in FIGS. 6 and 16, slotted region 164 is configured to accept float 111, which is freely slidable in slotted region 164. Float 111 preferably comprises an elongated piece with a series of apertures 169, shown in phantom in FIG. 16, extending through the float. Apertures 169 are preferably aligned with pivot receiving member 142 on major gripping member 134 at one end of the float, and with minor gripping member 112 attachment member 168 at the other end. As described below, major gripping member 134 is preferably pivotally attached to float 111 to permit retraction and extension of gripper mounting bar 110 relative to weight distribution beam 104, as well as to account for small gripping arm positional adjustments when clamping the multiple block unit. However, inasmuch as minor gripping member 112 preferably has two attachment points to float 111 the minor gripping member is locked in place relative to the gripper mounting bar.

Once both the major and minor gripping members 134 and 112 are attached to float 111 in a given position, they are set relative to one another. However, float 111 is slidably adjustable in slotted region 164 of gripping mounting bar 110, to permit minor positional adjustments of the opposing major and minor gripping members to accommodate variations in block hoist apparatus positioning, block positioning, or block size and dimensions.

Figure 18:
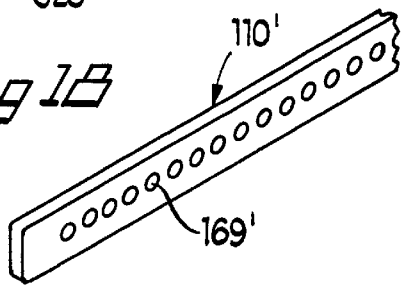
FIG. 18 of the drawings is a perspective view of the gripper mounting bar according to one embodiment of the present invention.

In another embodiment, shown in FIG. 18, gripper mounting bar 110' has no slotted region and no float, but instead includes a series of apertures 169'. The apertures provide a mounting location for major gripping member 134 and minor gripping member 112, while permitting adjustment of the distance between the respective gripping surfaces of the opposing major and minor gripping members.

In any embodiment, both major gripping member 134 and minor gripping member 112 are mounted on gripper mounting bar 110 such that a portion of both members extends into an Inner cavity of different blocks. This permits the block gripping surface on each opposing major and minor gripping member to grab the interior surface of different blocks.

Figure 27:
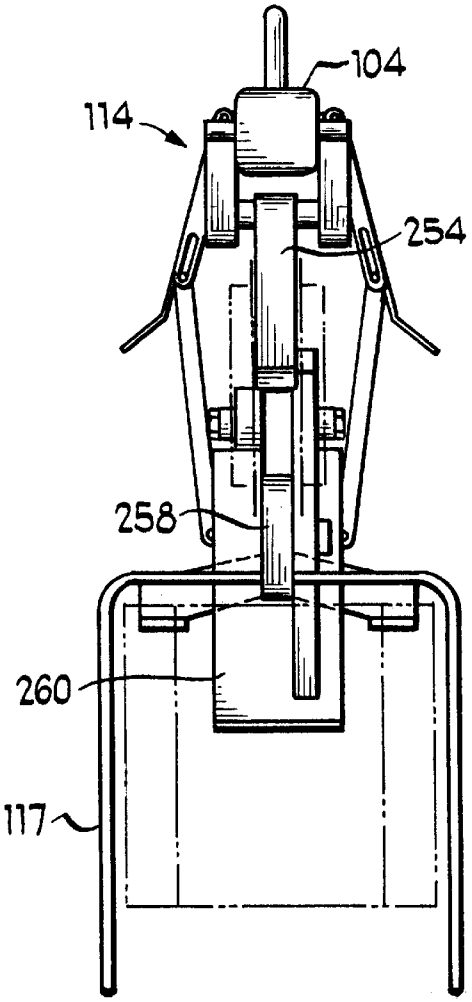
FIG. 27 of the drawings is a side elevational view of the block hoist apparatus shown in FIG. 24.

Positive lock clamp extender 114, shown in FIGS. 5, 6 and more particularly in FIGS. 26 and 27, extends from weight distribution beam 104 to gripper mounting bar 110 and comprises upper extensions 170, lower extensions 172, lower connector 174 and lever 176. Upper extensions 170 are pivotally connected to weight distribution beam 104, and further include notches 178 for pivotally accepting lower extensions 172. Lower extensions 172 are, in turn, pivotally connected to lower connector 174, which is attached to gripper mounting bar 110. Levers 178 extend from the bottom end of upper extensions 170, and serve to both lock the positive lock clamp extender into a first locking orientation, and release the positive lock clamp extender into a second retraction orientation. As will be discussed in more detail below, the first orientation fixes weight distribution beam 104 relative to gripper mounting bar 110, while the second orientation permits retraction of the gripper mounting bar relative to the weight distribution beam.

Supporting springs 116 extend from gripping arms 106 and 108 to gripper mounting bar 110. Supporting springs 116 facilitate retraction of gripper mounting bar 110 relative to weight distribution beam 104 when the block hoist apparatus is between hoists or not in use, while providing tension during locking of positive lock clamp extender 114.

Wall feelers 117, shown in FIGS. 5 and 27, are preferably mounted in pairs to both sides of the exposed ends of gripper mounting bars 110. Each wall feeler 117 preferably comprises a U-shaped flexible rod extending downward from the gripper mounting bars. Each pair of wall feelers is spaced a distance larger than the width of the blocks so as to help guide a multiple block unit clamped by the block hoist apparatus over a previously laid row of blocks.

Figure 15:
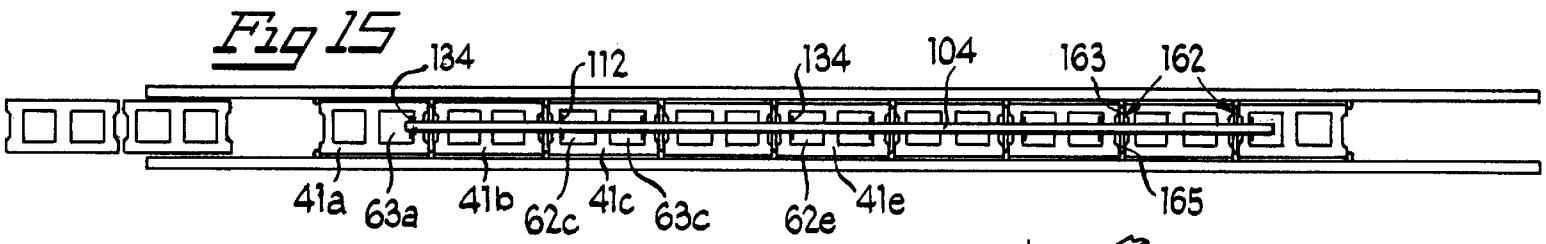
FIG. 15 of the drawings is a top plan view of the block hoist apparatus of FIG. 5 gripping a multiple block unit according to the present invention.

In operation, and as shown in FIGS. 5, 6 and 15, multiple block unit 43 is positioned beneath block hoist apparatus 40, If gripper mounting bars 110 are retracted relative to weight distribution beam 104, they are extended downwardly against the tension in tension springs 116. Positive lock clamp extender 114 may be locked either before insertion of the gripping members into the block cavities, or after insertion of gripping members, depending on operator skill and preference.

Next, major gripping members 134 and 135 and minor gripping members 112 and 113 are inserted into individual blocks in the multiple block unit, while spacers 162 are positioned between each block. In particular, and shown in FIGS. 5 and 15, major gripping member 134 is positioned into innermost cavity 63*a* of the outermost block 41*a*, while opposing and corresponding minor gripping member 112 is positioned in cavity 62*c* of block 41*c* spaced one block from block 41*a*. Likewise, major gripping member 135 is positioned in cavity 62*e* of block 41*e*, while opposing and corresponding minor gripping member 113 is positioned in inner cavity 63*c* of block 41*c* spaced one block from block 41*e*. Similarly, each set of major and minor gripping members associated with a pair of opposing gripping arms are preferably positioned into the inner cavities of blocks which are spaced one block apart.

Once the major and minor gripping members are positioned, and the gripper mounting bar locked relative to the weight distribution beam, the hoist is activated to lift the weight distribution beam. This lifting action, in turn, causes the opposing gripping arms, for instance gripping arms 106 and 108, to exert an inward clamping force along the interior portion of the blocks gripped by the major and minor gripping members. Moreover, given the proximate placement of the gripping members to the blocks which have no gripping members in direct contact, such as blocks 41*b* and 41*d*, the inward clamping force extends to those unengaged blocks to maintain each and every block in alignment for raising, transportation and lowering of the multiple block unit.

As seen in FIGS. 1, 5 and 6, each gripper mounting bar is preferably associated with two gripping arms, two major gripping members, and two corresponding paired minor gripping members. However, while weight distribution beam 104 is shown as supporting two gripper mounting bars, it may accommodate any number of gripper mounting bars and corresponding gripping arms according to the limitations of the hoist. For sake of illustration, and as is preferred, weight distribution beam is shown as supporting four gripping arms, four major gripping members, four minor gripping members, and two gripper mounting bars.

Moreover, block hoist apparatus 46 is preferably used in association with multiple block units which include an odd number of blocks. For instance, if one gripper mounting bar with two gripping arms was used, the major and minor gripping members would be positioned relative to five blocks. Of course, if only a single pair of major and minor gripping members was used with a single gripping arm, such would be best suited for a multiple block unit consisting of three blocks. Inasmuch as the major and minor gripping members are positioned in at least every other block, block hoist apparatus 46 is not limited by a block weight or the number of blocks.

In another embodiment, shown in FIG. 7, block hoist apparatus 180 comprises weight distribution beam 182, gripping arms 184 and 186, major gripping members 188 and 200, minor gripping members 202 and 204 and telescoping gripper mounting bars 206 and 208. Specifically, while gripping arms 184 and 186 still extend downwardly from a pivotal attachment to weight distribution beam 182 and terminate in major gripping members 188 and 200 as substantially described above, gripper mounting bar 110 of FIGS. 5 and 6 is replaced by telescoping gripper mounting bars 206 and 208.

Telescoping gripper mounting bars 206 and 208 comprise outer telescoping members 210 and 212 and inner telescoping members 214 and 216. Major gripping members 188 and 200 are attached to outer telescoping members 208 and 210 of telescoping gripper mounting bars 206 and 208, respectively, while minor gripping members 202 and 204 are attached to inner telescoping members 214 and 216, respectively. For purposes of illustration, only telescoping gripper mounting bar 206 will be discussed with the understanding that the explanation applies to telescoping gripper mounting bar 208.

Inner telescoping member 214 slides in outer telescoping member 210 to permit adjustment of the distal spacing between the major and minor gripping members. Such spacing may be adjusted to accommodate blocks of varying size and dimensions. Inner telescoping member 214 may be locked relative to the outer telescoping member 210 by stopping pin 218, which is preferably inserted through the outer telescoping member and inner telescoping member. Additionally, another stopping pin 220 may be used to ensure that the distance between the major and minor gripping member does not change during lifting and transportation of the multiple block unit. Moreover, while not shown, a supporting spring, such as supporting spring 116 in FIGS. 5 and 6, may be used to connect the gripping arms to the outer telescoping members of the telescoping gripper mounting bars.

Furthermore, while FIG. 7 depicts two pairs of major and minor gripper members connected by a telescoping gripping mounting member, block hoist apparatus 180 may include any number of gripping members to accommodate any number of desired blocks in a multiple block unit.

Figure 9:
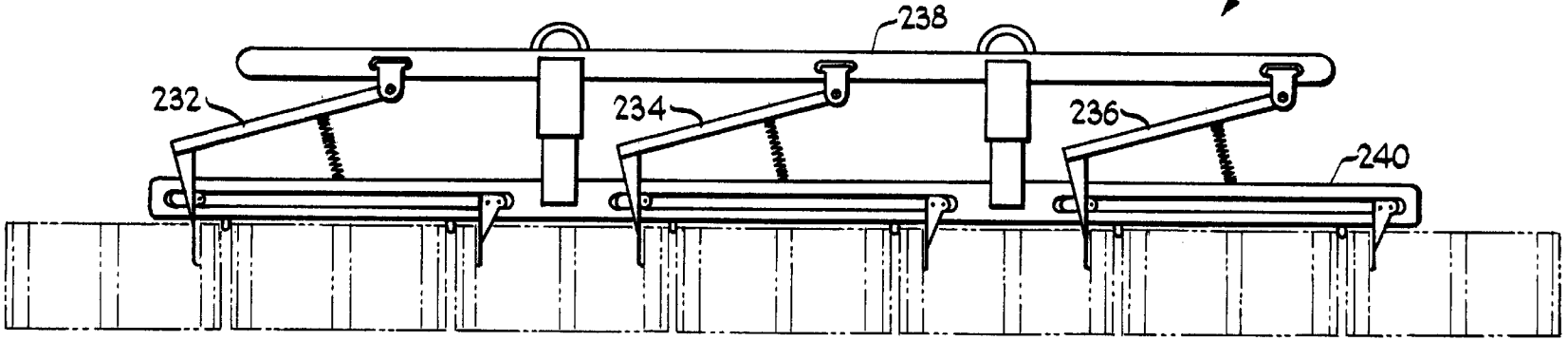
FIG. 9 of the drawings is a front elevational view of the block hoist apparatus according to still another embodiment of the present invention.

In yet another embodiment, shown in FIG. 9, block hoist apparatus 230 includes the same elements as were described in relation to FIGS. 5 and 6, except that gripping arms 232, 234 and 236 all extend downward at substantially the same angle from weight distribution beam 238. In particular, while each gripping arm ends in a major gripping member which is distally spaced from and opposing a minor gripping member, as described above, each gripping arm, major gripping member and minor gripping member unit is oriented in substantially the same direction. Thus, while the gripping arms do not oppose each other, lifting of the weight distribution beam still transforms each gripping arm into a lever arm. Accordingly, a clamping force is applied along the interior portion of the inner cavity of the blocks positioned between each set of opposing major and minor gripping members. Moreover, while only one gripper mounting bar 240 is shown for use with this embodiment, multiple gripper mounting bare are likewise contemplated.

Figure 8:
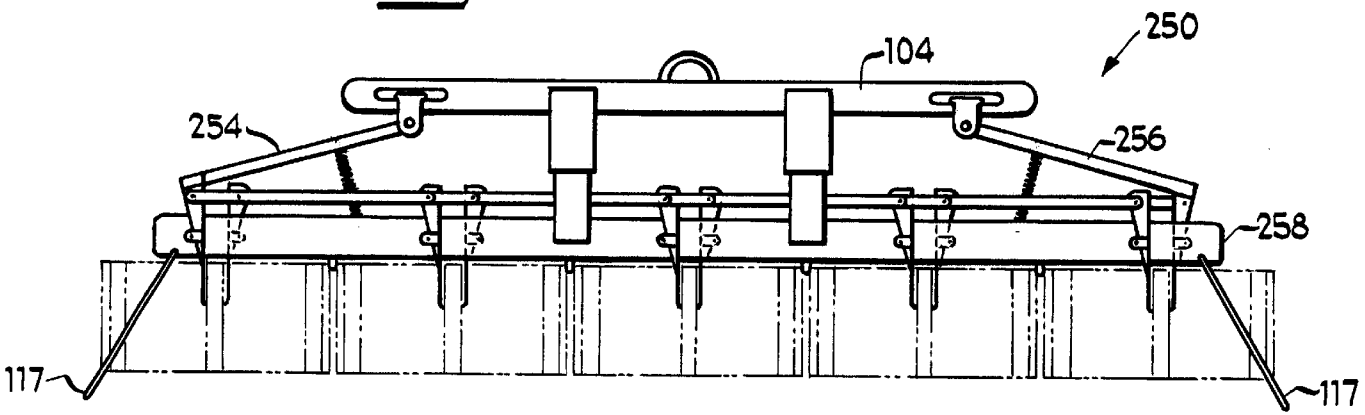
FIG. 8 of the drawings is a front elevational view of the block hoist apparatus according to yet another embodiment of the present invention.
Figure 28:
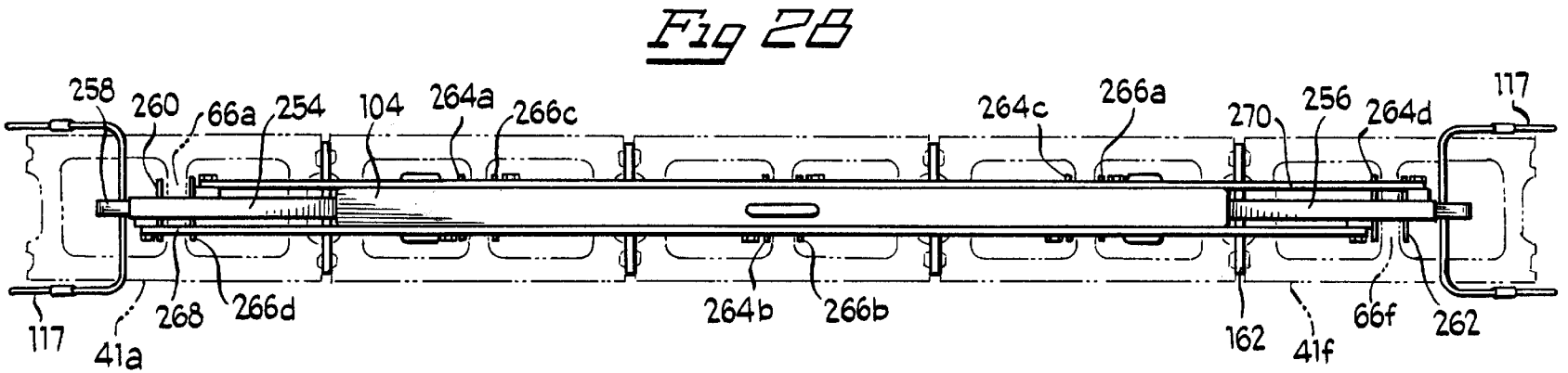
FIG. 28 of the drawings is a top plan view of the block hoist apparatus shown in FIG. 24.

In yet another embodiment, shown in FIGS. 8 and 24–28, block hoist apparatus 250 comprises weight distribution beam 104, gripping arms 254 and 256, gripper mounting bar 258, first major gripping member 260, second major gripping member 262, first series of minor gripping members 264, second series of minor gripping members 266, first connecting rail 268, second connecting rail 270, positive lock clamp extender 114, supporting springs 116 and wall feelers 117. To the extent that the components of block hoist apparatus 250 are similar to those described above in reference to block hoist apparatus 46, like reference numerals will be used for like parts, and the above description will be understood to apply to the present embodiment. Moreover, as will become clear with the description to follow, while FIGS. 8, 24 and 28 show four sets of minor gripping members associated with the weight distribution beam for hoisting five blocks, the weight distribution beam and gripper mounting bar may likewise be modified to accommodate any number of blocks.

Like the above described embodiments of the block hoist, gripping arms 254 and 256 are pivotally mounted to weight distribution beam 104. Major gripping members 260 and 262 likewise emanate from the second end of gripping arms 254 and 256, respectively. Still similarly, the major gripping members are pivotally mounted to gripper mounting bar 258. Moreover, it is also contemplated that the gripper mounting bar includes numerous mounting ports for the major gripping members to permit adjustment to accommodate various block sizes and dimensions. However, unlike the previous embodiments, first major gripping member 260 is pivotally attached to first connecting rail 268 and second major gripping member 262 is pivotally attached to second connecting rail 270.

Figure 21:
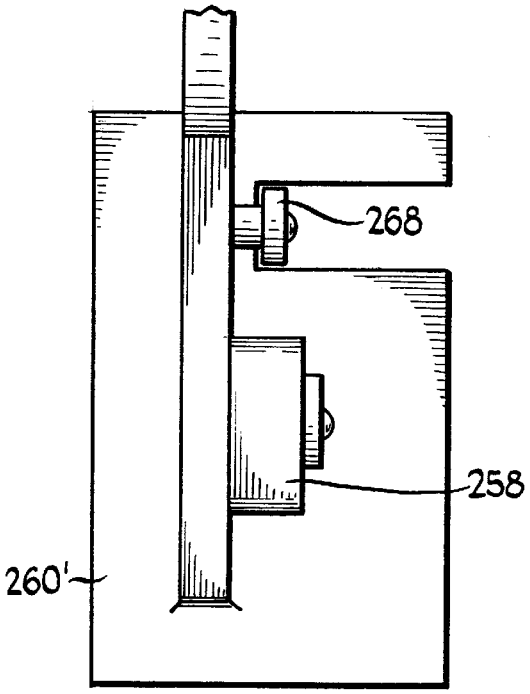
FIG. 21 of the drawings is 2 side elevational view of the block hoist apparatus shown in FIG. 17.
Figure 20:
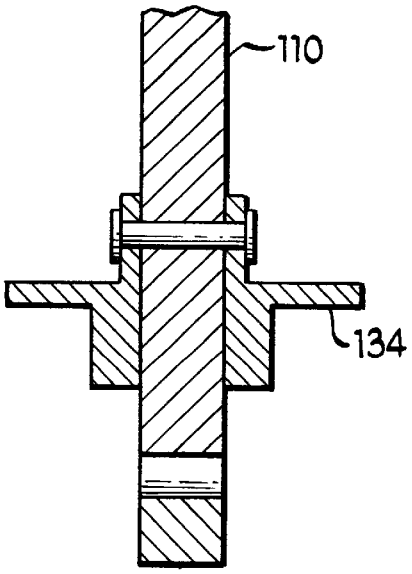
FIG. 20 of the drawings is a top plan cross-sectional view of FIG. 19 taken along the lines 20—20.
Figure 22:
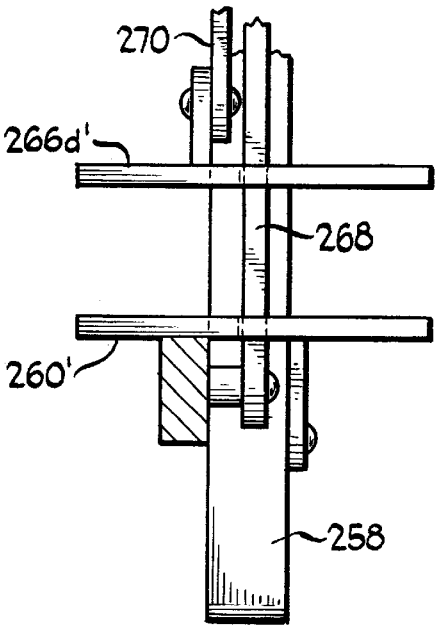
FIG. 22 of the drawings is a top plan cross-sectional view of FIG. 21 taken along the lines 22—22.
Figure 25:
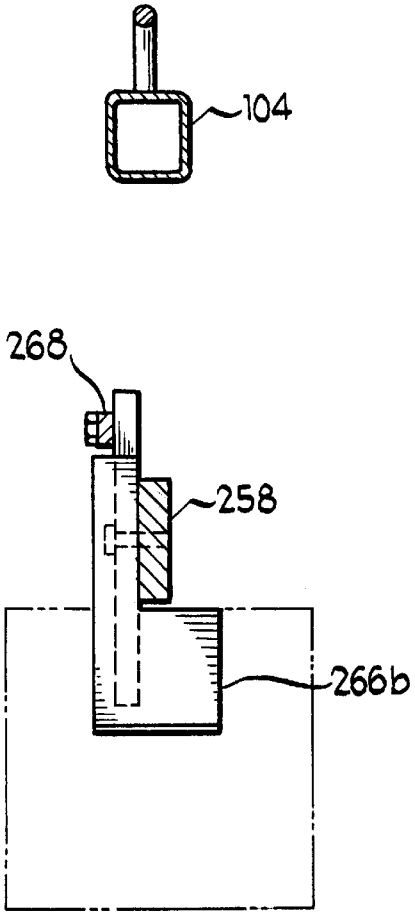
FIG. 25 of the drawings is a side elevation cross-sectional view of FIG. 24 taken along the lines 25—25.

In one embodiment, shown in FIGS. 25 and 27, gripping members are substantially L-shaped to allow pivotal attachment to both the connecting rails and the gripper mounting bars, without interfering with movement of the opposing connecting rail. In another embodiment shown in FIGS. 17, 20 and 21, gripping members, designated with prime reference numerals, have slots on either one or both sides to accommodate the first and second connecting rails.

As shown in FIG. 24, both first and second connecting rails include apertures 274 and 276, respectively, for receiving both major gripping members 260 and 262 and minor gripping members 264 and 266. In particular, each of first series of minor gripping members 264 is pivotally mounted at set intervals to first connecting rail 268 such that the first series of minor gripping members have block gripping surfaces which face in the same direction as the block gripping surface of first major gripping member 260. Likewise, each of second series of minor gripping members 266 is pivotally mounted at set intervals to second connecting rail 270 such that the second series of minor gripping members have block gripping surfaces which face in the same direction as the block gripping surface of second major gripping member 262. Thus, inasmuch as the first and second major gripping members oppose one another, each of the first and second series of minor gripping members likewise face in opposite directions.

Each of the minor gripping members is also pivotally mounted to gripper mounting bar 258. Like each of the first and second connecting rails, the gripper mounting bar preferably includes multiple gripping member mounting ports 278 and 280, respectively, for permitting adjustment of the first series and second series of minor gripping members along the gripper mounting bar to accommodate blocks of varying size and dimensions.

In operation, the gripping members are inserted into the block cavities. However, unlike the previous embodiments, each gripping member is positioned proximate a center web of each block in the multiple block unit, such that each gripping member attached to the first connecting rail working in combination with a gripping member from the second rail to grip a separate block. In particular, first major gripping member is inserted into end block 41*a* on the outermost side of center web 66*a*, while second series minor gripping member 266*d* is inserted into the same end block 41*a*, but on the opposite side of center web 66*a*. Likewise, second gripping member is positioned into opposite end block 41*f* on the outermost side of center web 66*f*, while first series minor gripping member 264*d* is positioned into the same block 41*f*, but on the opposite side of center web 66*f*. This pattern allows each of the remaining first series minor gripping members to be paired with and to oppose a second series minor gripping member.

Thus, upon lifting of weight distribution beam 104, the gripping arms exert a force inward thus activating a clamping force by not only the first and second major gripping members, but also by all the series of minor gripping members connected to the first and second major gripping members on the respective first and second connecting rails 268 and 270. The substantially equal and opposite forces produced by the first and second series of gripping members clamps the center web of each block in the multiple block unit, thus permitting lifting of same while maintaining alignment of the blocks in the multiple block unit.

Mortar applying apparatus 48, shown in FIGS. 10–14, comprises a mortar source, mortar applicator 300, conduit 302 for feeding mortar from mortar source to the applicator, housing 304, means for controlling the dispensing of mortar 306 and laser sensitive indicator 307. The mortar source may comprise any conventional reservoir of mortar, which may be delivered through conduit 902 to mortar applicator 300. While conduit 302 is preferably flexible to allow for movement of mortar applying apparatus 48 in any direction, it is likewise contemplated that conduit is rigid and moves with mortar applying apparatus.

Housing 304 comprises outer shell 310, guide 312, mortar distribution chamber 314 and handle member 328. Guide 312 preferably includes four wheels 316 which extend from outer shell 310. Wheels 316 include a central groove 318 defining a horizontal wheel surface 320 and a vertical wheel surface 322. Central groove is preferably a 90° angle corresponding to the 90° angle found on the corner of most blocks, so that the wheels match the shape of the corner of the block in traversing a row of blocks. Horizontal wheel surface 320 rides substantially on top surface 324 of the row of blocks, while vertical wheel surface 322 rides substantially along side surface 326 of the row of blocks. Such a wheel design increases stability of the housing on the top surface of the blocks, and increases accuracy of mortar application. Additionally, contact of the wheels with the top surface of the block is minimized, thus limiting interference with application of mortar onto the edges of the top surface of the block.

Additionally, wheels 316 may be mounted on an axis that is adjustable relative to housing and outer shell to permit vertical adjustment of mortar applying apparatus 48 relative to the top surface of the blocks. In particular, the distance between the mortar dispensing ports, discussed below, and the block surfaces dictates the thickness of the applied mortar. That distance may be adjusted by adjustment of the wheel axis to increase or decease the thickness of the mortar layer.

Figure 10:
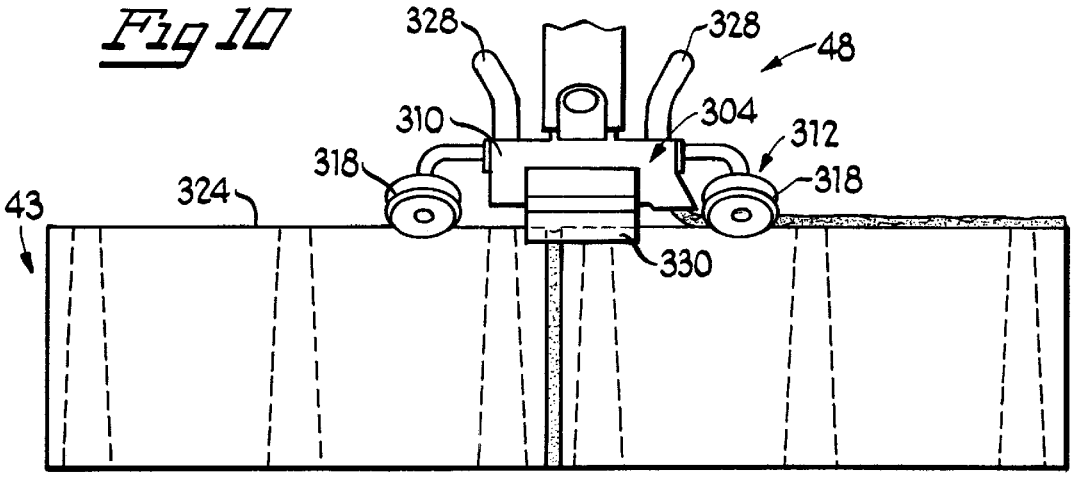
FIG. 10 of the drawings is a side elevational view of the mortar applying apparatus according to one embodiment of the present invention.
Figure 12:
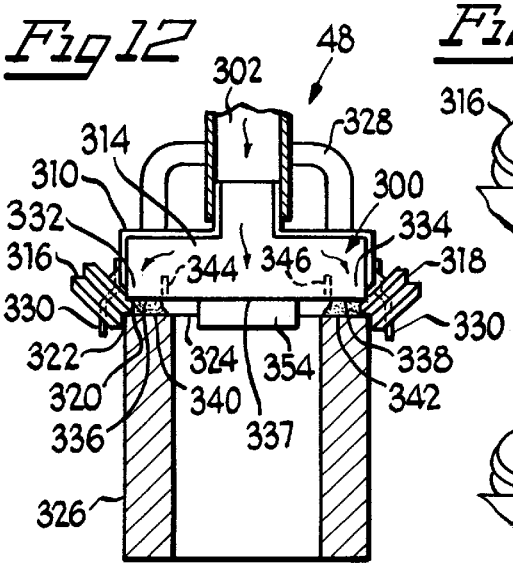
FIG. 12 of the drawings is a front elevation cross-sectional view of the mortar applying apparatus of FIG. 10.

Housing guide 312 further comprises a pair of shields 330, shown in FIGS. 10 and 12, disposed on both sides of mortar applying apparatus 46. Each shield 330 has two ends, one end attached to outer shell 310 of the housing, and the other end extending below the housing. When positioned over row of blocks 43, the shields extend below block surface 324 to prevent misalignment of the mortar applying apparatus. In particular, shields 330 contact side surface 326 of the blocks upon deviation of the mortar applying apparatus from proper alignment over the row of blocks.

Handle member 328 preferably extends from the top surface of outer shell 310. Handle member 328 may take the form of outwardly extending handles, shown in FIGS. 10 and 11. Likewise, handle members may also comprise a U-shaped bar extending over the top of the housing, shown in FIG. 12. Handle member allows manual manipulation of mortar applying apparatus 48.

Figure 11:
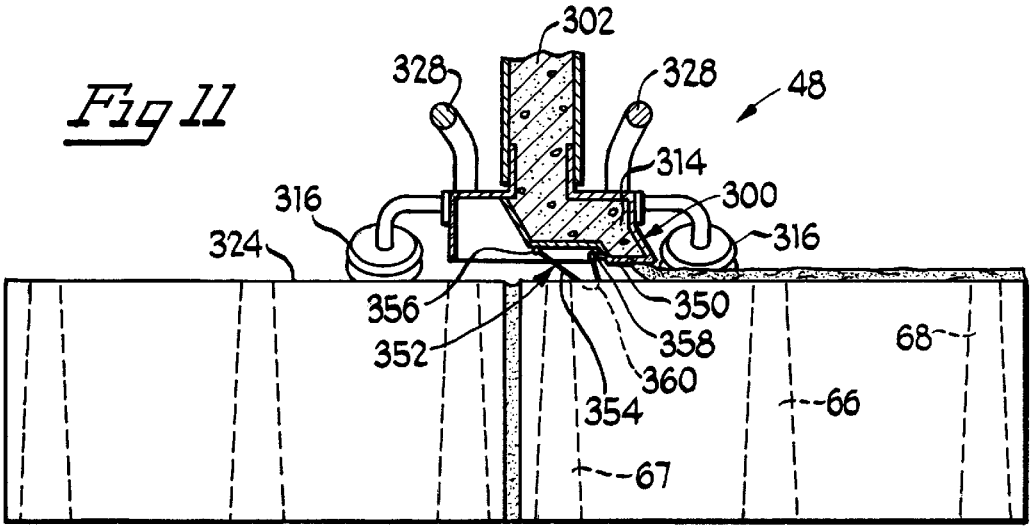
FIG. 11 of the drawings is a side elevation cross-sectional view of the mortar applying apparatus of FIG. 10.
Figure 13:
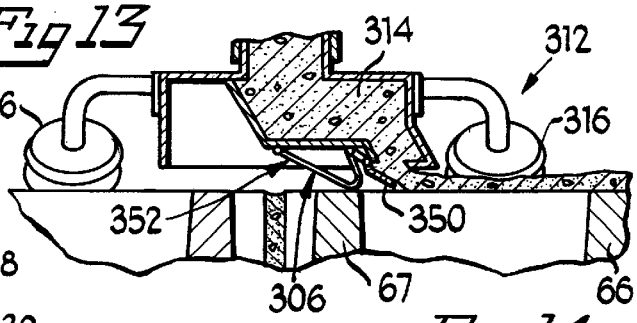
FIG. 13 of the drawings is a side elevation cross-sectional view of the mortar applying apparatus of FIG. 10 during opening of the dispensing gate.

Mortar distribution chamber 314, shown in FIGS. 11–13, is preferably divided into two outer channels 332 and 334 and inner channel 333. Each channel, in turn, terminates in mortar dispensing ports 336, 337 and 338, respectively, from which mortar is dispensed to the top surface of the row of blocks. Outer dispensing ports 336 and 338 are preferably remain open at all times, to permit continuous dispensing of mortar onto outer top sides 340 and 342 of the top surface of each block, while inner port 337 is covered by gate 350 as described below. Inasmuch as outer top side regions 340 and 342 are substantially solid, with few or no apertures, mortar is not wasted. It is likewise contemplated, however, that outer ports 336 and 338, like inner port 337, have adjustable valves or covers which selectively limit mortar application onto the top of the block surface.

Channels 332, 333 and 334 are preferably created by dividers 344 and 346, shown in FIG. 12. The dividers are preferably ramped or conical to funnel mortar into respective channel regions 332, 333 and 334 for even distribution onto the top of the block surface.

Means for controlling dispensing of mortar 306, shown in FIGS. 11–13, comprises gate 350 and sensor 352. Gate 350 preferably covers inner dispensing port 337 and is spring loaded to resist opening prematurely under the weight of the mortar. Sensor 352 preferably comprises a dip sensor 354 having a first end 356, a second end 358 and a dip portion 360 positioned therebetween. First end 599 is pivotally attached to the bottom portion of mortar distribution chamber 314, while second end 358 end is pivotally attached to gate 350. Dip portion 360 extends below the mortar distribution chamber and the outer shell. Moreover, the dip portion also extends below the top of the block surface upon placement of the mortar applying apparatus into position over the top surface of the row of blocks. Upward movement of dip portion 360 triggers a downward movement and opening of pivotally attached gate 350. Opening of the gate opens inner port 337 to allow dispensing of mortar from channel 333 of the mortar distribution chamber to the top surface of the blocks.

Figure 14:
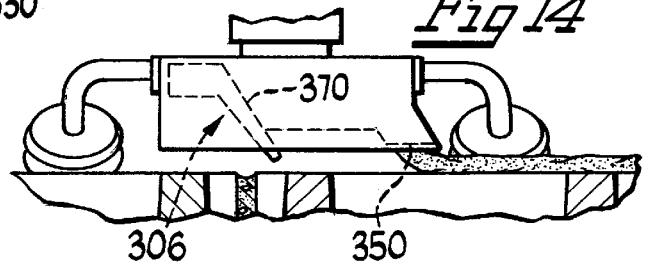
FIG. 14 of the drawings is a side elevation cross-sectional view of the mortar applying apparatus according to another embodiment of the present invention.

In another embodiment shown in FIG. 14, sensor 352 comprises laser 370 associated with applicator housing. Laser 370 may be integral to the outer shell or a separate component extending therefrom. Laser preferably forms part of an electric circuit that triggers opening of gate 350 upon sensing the top block surface.

Figure 29:
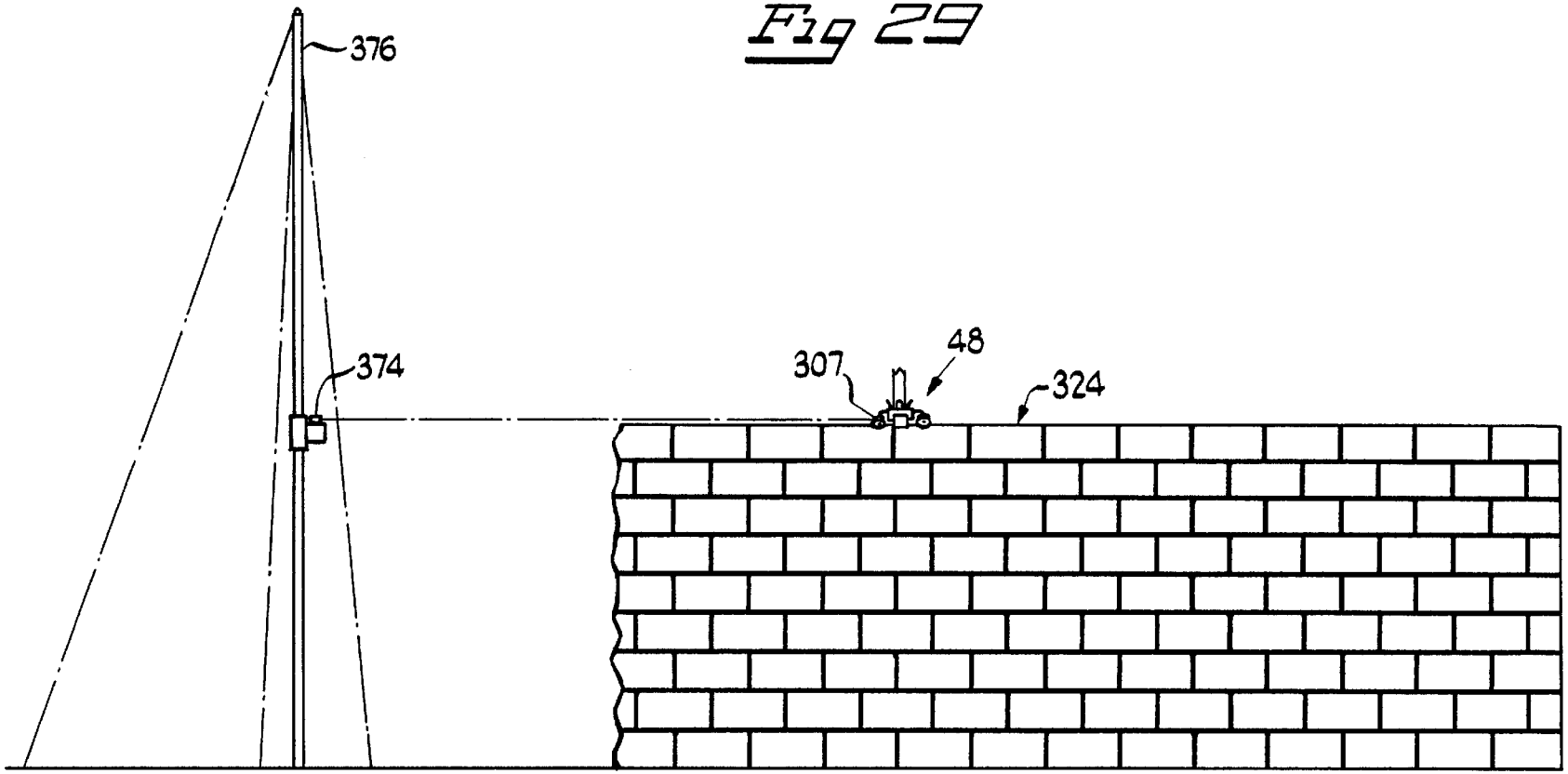
FIG. 29 of the drawings is a side elevational view of the mortar applying apparatus with a laser sensitive indicator according to the present invention.

Laser sensitive indicator 307, shown in FIG. 29, is associated with the outer shell of the mortar applying device and used in combination with laser 374 mounted on pole 376. Laser 374 and laser sensitive indicator 307 act to level the course of the mortar applying device as it traverses top surface 324 of blocks, as would be know by those with ordinary skill in the art with the present disclosure before them. Moreover, pole 376 also preferably includes detents spaced at set intervals for positioning of laser 374 at different heights for application of mortar to different rows of blocks. Additionally, laser 374 may be associated with a cable pulley or other hoisting mechanism to vertically adjust the laser on the pole.

In operation, mortar applying apparatus device 48 is placed on the top surface of a row of blocks. Mortar is fed into mortar distribution chamber 314, where it is channeled to outer ports 336 and 338 and to inner port 337. Inasmuch as the outer ports preferably remain open, mortar is dispensed onto outer top surfaces 340 and 342 of the blocks, which typically has very few holes or gaps. When mortar applying device 48 is positioned over a block cavity, shown in FIGS. 11 and 12, dip sensor 354 generally falls within that block cavity. In such a position, gate 350 remains closed, thus preventing mortar application through inner port 337 and into the block cavities, where it is wasted. However, upon contact of dip sensor 354 with any of block webs 66, 67 or 68, and as shown in FIG. 13, the dip sensor is forced upward. Upward movement of the dip portion, in turn, triggers a downward movement and opening of the gate. Thus, the inner port is opened to allow mortar dispensing. Upon encountering another block cavity, the dip sensor enters that cavity, thus forcing the gate closed.

In operation of the entire block laying system, blocks 41 are first positioned end to end at set intervals on conveyor 74 to create block gaps 73. The blocks are then transported to a position below mortar injection device 42. At the mortar injection device 42, mortar is injected into the block gaps to form a mortar joint between each block. Additionally, the blocks are tamped by vibrating tamper 82 to promote uniform settling of the mortar into the block gaps. Injection of mortar creates an integral row of blocks and a multiple block unit 43.

Multiple block unit 43 is then conveyed to a position beneath block hoist apparatus 46. The block hoist apparatus is positioned over the multiple block unit, and gripper mounting bar 104 is pulled away from the weight distribution beam 110 and locked into an expanded position relative to the weight distribution beam with positive lock clamp extenders 114. Substantially simultaneously, or immediately thereafter, the major and minor gripping members are inserted into their appropriate block cavities, as described above. In this position, the gripping faces on both the major and minor gripping members are positioned against the respective inner surface of the inner cavity of the blocks.

The hoist is then activated to lift the weight distribution beam, thus forcing the gripping arms to impart an inward clamping force along the interior portion of the inner cavity of the blocks. The major and minor gripping members, in turn, retain all of the blocks in the multiple block unit in alignment.

The multiple block unit may then be transported by the hoist, and positioned on a preselected location. After positioning of the blocks, and disengagement of the gripping members from the block cavities, the top surface of the blocks may then be mortared with mortar applying device 48 according to the above description.

The foregoing description and drawings merely explain and illustrate the invention, and the invention is not limited thereto except insofar as the appended claims are so limited as those skilled in the art who have the present disclosure before them will be able to make modifications and variations therein without departing from the scope of the invention.

What is claimed is:

1. A system for laying masonry blocks in multiple-block unite, for masonry blocks each having two opposing sides, two opposing ends, a top, a bottom and at least one inner cavity extending into the block from an aperture in the top surface, and for masonry blocks positioned upon entry to said system such that each block has at least one end which is adjacent to the end of at least one other block and such that the blocks are positioned at predetermined intervals so as to create a gap between at least a portion of each adjacent block end, said block-laying system comprising:

a mortar injection device for injecting mortar into the gap between at least a portion of each pair of adjacent blocks, thereby forming a mortar joint therebetween and, in turn, an integral row of blocks and a multiple block unit;

a block hoist apparatus for raising and lowering blocks formed into a_multiple-block unit, the block hoist apparatus configured to clamp blocks arranged in a multiple block unit through the inner cavity of at least one of the blocks such that the block hoist apparatus maintain blocks formed into a multiple block unit in alignment;

a mortar laying apparatus for selectively dispensing mortar onto the top surface of blocks which have been formed into a multiple-block unit, while substantially limiting mortar application into the inner cavity of the blocks through the block apertures.

2. The block-laying system according to claim 1 further comprising a block positioning station for positioning blocks such that each block has at least one end which is adjacent to an end of at least one other block and spacing the blocks at predetermined intervals so as to create a gap between at least a portion of each adjacent block.

3. The block-laying system according to claim 1 wherein said mechanical hoist is mounted on a travel rail to permit transverse movement of said mechanical hoist and transverse displacement of a multiple-block unit between raising and lowering of a multiple block unit by said block hoist apparatus.

4. The block-laying system according to claim 1 wherein said mortar injection device includes at least one mortar dispensing chute for injecting mortar into the gap between adjacent blocks.

5. The block-laying system according to claim 4 wherein said mortar is fed to the at least one chute by a pressure driven pump.

6. The block-laying system according to claim 4 wherein said mortar is fed to said at least one chute by a motor-driven auger.

7. The block-laying system according to claim 4 wherein said mortar injection device includes mortar dispensing chutes corresponding to each gap between blocks in a multiple block unit having at least three blocks.

8. The block-laying system according to claim 1 further comprising a tamper to facilitate substantially uniform settling of mortar between adjacent blocks to facilitate formation of multiple block units.

9. The block-laying system according to claim 8 wherein said tamper comprises a vibratory roller for settling mortar joints formed between adjacent blocks.

10. The block-laying system according to claim 8 wherein said tamper comprises at least one hydraulic piston operably associated with said mortar injection device for delivering intermittent taps to mortar joints formed between adjacent blocks.

11. The block-laying system according to claim 10 wherein said tamper comprises a plurality of hydraulic pistons attached to said mortar injection device and positioned at spaced intervals corresponding to gaps between blocks in a multiple block unit.

12. A system for laying masonry-blocks in multiple-block units, for masonry blocks each having two opposing sides, two opposing ends, a top, a bottom and at least one inner cavity extending into the block from an aperture in the top surface, and for masonry blocks positioned upon entry to said system such that each look has at least one end which is adjacent to the end of at least one other block and such that the blocks are positioned at predetermined intervals so as to create a gap between at least a portion of each adjacent block end, said block-laying system comprising:

a mortar injection device for injecting mortar into the gap between at least a portion of each pair of adjacent blocks, thereby forming a mortar joint therebetween and, in turn, an integral row of blocks and a multiple block unit;

a block hoist apparatus for raising and lowering blocks which have been formed into a multiple-block unit, the block hoist apparatus configured to clamp blocks arranged in a multiple block unit through the inner cavity of at least one of the blocks such that the block hoist apparatus maintains blocks formed into a multiple block unit in alignment;

a mortar laying apparatus for selectively and controllably dispensing mortar onto the top surface of blocks which have been formed into a multiple-block unit, while substantially limiting mortar application into the inner cavity of the blocks through the block apertures;

said block hoist apparatus comprising:

a hoist transmission member for connecting the block hoist apparatus to a mechanical hoist for raising and lowering the apparatus;

a weight distribution beam connected to said hoist transmission member;

at least two gripping arms operably extending from said weight distribution beam, each gripping arm having a first end and a second end, said first end of each gripping arm pivotally attached to said weight distribution beam so as to allow each gripping arm to pivot freely through a range of positions generally defining a plane occupied by each gripping arm;

said at least two gripping arms extending downwardly from said weight distribution beam and terminating at their respective second ends, said second end of each gripping arm including a major gripping member having a block gripping surface;

at least a portion of each of said major gripping members mounted to a gripper mounting bar, said gripper mounting bar having a top surface, a bottom surface, two side surfaces and two ends;

said gripper mounting bar positioned below said weight distribution beam with at least a portion of the gripping surface of each major gripping member extending below said bottom surface of the gripper mounting bar for positioning at least a portion of each major gripping member into the inner cavity of different blocks which form a multiple block unit;

at least one opposing minor gripping member attached to said gripper mounting bar in a position spaced distally apart from and cooperating with each major gripping member, said at least one opposing minor gripping member having a block gripping surface, at least a portion of the gripping surface of each minor gripping member extending below said bottom surface of the gripper mounting bar for positioning at least a portion of each minor gripping member into the inner cavity of at least one block which is a part of a multiple block unit, each of said minor gripping members cooperating with each of said corresponding major gripping members upon lifting of said weight distribution beam by said mechanical hoist to exert a clamping force along an interior portion of the inner cavity of blocks which are in contact with said major and minor gripping members for retaining blocks in alignment, for simultaneous raising and lowering of blocks in a multiple block unit by said hoist transmission member.

13. The block-hoist apparatus according to claim 12 wherein each of said major gripping members is positioned in a first engaging block separated by at least one block from a second engaging block in which its cooperating minor gripping member is positioned such that the clamping force exerted along the interior portion of the inner cavity of the first and second engaging blocks retains the first engaging block, the second engaging block, and any blocks positioned therebetween in alignment for simultaneous raising and lowering of same.

14. The block-hoist apparatus according to claim 13 wherein each of said major gripping members is positioned in a first engaging block such that each of said major block gripping surfaces engages the first engaging block in the inner cavity that is nearest said minor gripping member.

15. The block-hoist apparatus according to claim 14 wherein each of said minor gripping members is positioned in a second engaging block such that each of said minor block gripping surfaces engages the second engaging block in the inner cavity that is nearest said major gripping member.

16. The block-hoist apparatus according to claim 14 wherein said minor gripping member is substantially fixed relative to said gripper mounting bar, but wherein said major gripping member is pivotally attached to said gripper mounting bar for pivotal adjustment during lifting and clamping of a multiple block unit.

17. The block-hoist apparatus according to claim 14 wherein said distal spacing between said corresponding major and minor gripping members is adjustable to accommodate different block dimensions.

18. The block-hoist apparatus according to claim 17 wherein said gripper mounting bar includes a plurality of minor gripper member mounting ports to permit adjustment of said minor gripping members along said gripper mounting bar to, in turn, adjust the distal spacing between said corresponding major and minor gripping members.

19. The block-hoist apparatus according to claim 14 wherein each set of corresponding major and minor gripping members are mounted to a single telescoping gripper mounting bar.

20. The block-hoist apparatus according to claim 19 wherein each of said telescoping gripper mounting bars comprise:

an outer telescoping member attached to said major gripping member, said outer telescoping member including at least one aperture capable of accepting a locking member;

an inner telescoping member attached to said minor gripping member, said inner telescoping member including at least one mating aperture capable of corresponding to said at least one outer telescoping member aperture and also capable of accepting said locking member;

said inner telescoping member slidably adjustable in said outer telescoping member to effectively alter the distal spacing between said major and minor gripping members.

21. The block hoist apparatus according to claim 20 wherein the distal spacing between said major and minor gripping members may be fixed by inserting the locking member through said at least one aperture in said outer telescoping member and through said at least one corresponding mating aperture in said inner telescoping member to permit clamping and lifting of a multiple block unit.

22. The block-hoist apparatus according to claim 14 wherein each gripper mounting bar is associated with two major gripping members, each of which is associated with a gripping arm that extends at a downward angle from said weight distribution beam, said gripping arms extending from said weight distribution beam at opposite downward angles.

23. The block-hoist apparatus according to claim 13 wherein each of the major and minor gripping members is associated with a single gripper mounting bar and wherein said gripping arms extend at a downward angle from said weight distribution beam at substantially the same angle.

24. The block-hoist apparatus according to claim 13 further comprising:

a first connecting rail extending from a first major gripping member, said first major gripping member having a block gripping surface facing a first direction;

a first series of minor gripping members attached to said first connecting rail at intervals for positioning of each of said first series of minor gripping members into the inner cavity of a different block in a multiple block unit, each of said first series of minor gripping members also having a block gripping surface facing said first direction;

a second connecting rail extending from a second major gripping member having a block gripping surface facing a second direction substantially opposite said first direction, a second series of minor gripping members attached to said second connecting rail at intervals for positioning of each of said second series of minor gripping members into the inner cavity of a different block in a multiple block unit, each of said second series of minor gripping members also having a block gripping surface facing said second direction, one of said first gripping member and said first series of minor gripping members cooperating with one of said second gripping member and said second series of minor gripping members, upon lifting of said weight distribution beam, to exert a clamping force on the interior portion of the center web of each block in a multiple block unit for retaining blocks in a-multiple block unit in alignment, for simultaneous raising and lowering of same.

25. The block-hoist apparatus according to claim 24 wherein said first major gripping member, said second major gripping member and said first and second series of minor gripping members are pivotally mounted on said respective first and second connecting rails to permit clamping adjustment upon lifting of a multiple block unit.

26. The block-hoist apparatus according to claim 24 wherein said first major gripping member, said second major gripping member, and said first and second series of minor gripping members are pivotally mounted on said gripper mounting bar.

27. The block-hoist apparatus according to claim 24 wherein said first and second series of minor gripping members are adjustable along both the respective first and second connecting rails and said gripper mounting bar.

28. The block-hoist apparatus according to claim 24 wherein a plurality of block spacers are associated with said gripper mounting bar at set intervals for insertion between blocks to maintain block spacing in a multiple block unit.

29. The block-hoist apparatus according to claim 28 wherein said block spacers are adjustable in position along said gripper mounting bar.

30. The block-hoist apparatus according to claim 24 wherein said gripper mounting bar further includes at least one slot and a float slidably receivable in said at least one slot, and wherein said major gripping members and said respective opposing minor gripping members are each mounted to said gripper mounting bar at said at least one float, whereby said at least one float maintains the distal spacing between said opposing major and minor gripping members and permits positional adjustment of said opposing major and minor gripping members for insertion into a multiple block unit.

31. The block-hoist apparatus according to claim 13 further including at least one positive lock clamp extender connecting said weight distribution beam and said gripper mounting bar and having at least two orientations, a first orientation permitting retraction of said at least one gripper mounting bar relative to said weight distribution beam and a second orientation locking said gripper mounting bar relative to said weight distribution beam.

32. The block-hoist apparatus according to claim 31 wherein said positive lock clamp extender further includes a release for carrying said positive lock clamp extender from said second locking orientation to said first retracting orientation.

33. The block-hoist apparatus according to claim 31 further including a supporting spring positioned between each of said gripping arms and said gripper mounting bar to facilitate retraction of said gripper mounting bar relative to said weight distribution beam and to facilitate carrying said positive lock clamp extender from said first retracting orientation to said second locking orientation.

34. The block-hoist apparatus according to claim 13 wherein said weight distribution beam further includes at least one hook positioned thereon for connecting said hoist transmission member to said mechanical hoist.

35. The block-hoist apparatus according to claim 13 further comprising at least one wall feeler extending downwardly from said gripper mounting bar to facilitate positioning of a multiple block unit on a predetermined area.

36. The block-hoist apparatus according to claim 13 wherein said weight distribution beam further comprises at least one slot corresponding to each gripping arm and associated major gripping member;

at least one swivel joint is slidably mounted in said at least one slot, each major gripping member is pivotally associated with said weight distribution beam at said swivel joint, whereby said swivel joint and said associated major gripping member are slidably adjustable in said slot to accommodate differing block size and dimensions.

37. The block-hoist apparatus according to claim 13 wherein at least one of said major gripping members is pivotally attached to said gripper mounting bar.

38. The block-hoist apparatus according to claim 13 wherein said block gripping surface of at least one of said major and minor gripping members includes a grip enhancer.

39. The block-hoist apparatus according to claim 38 wherein said grip enhancer comprises one of the following from the group consisting of protrusions, spikes and corrugations.

40. A system for laying masonry blocks in multiple-block units, for masonry blocks each having two opposing sides, two opposing ends, a top, a bottom and at least one inner cavity extending Into the block from an aperture in the top surface, and for masonry blocks positioned upon entry to said system such that each block has at least one end which is adjacent to the end of at least one other block and such that the blocks are positioned at predetermined intervals so as to create a gap between at least a portion of each adjacent block end, said block-laying system comprising:

a mortar injection device for injecting mortar into the gap between at least a portion of each pair of adjacent blocks, thereby forming a mortar joint therebetween and, in turn, an integral row of blocks and a multiple block unit;

a block hoist apparatus for raising and lowering blocks which have been formed into a multiple-block unit, the block hoist apparatus configured to clamp blocks arranged in a multiple block unit through the inner cavity of at least one of the blocks such that the block hoist apparatus maintains blocks formed into a multiple block unit in alignment;

a mortar laying apparatus for selectively and controllably dispensing mortar onto the top surface of blocks which have been formed into a multiple-block unit, while substantially limiting mortar application into the inner cavity of the blocks through the block apertures said mortar laying apparatus comprising:

an applicator for applying a substantially uniform coat of mortar to the top surface of a row of blocks, said applicator including a port;

a housing for the mortar applicator, including a housing guide extending from said housing to allow said housing to controllably traverse a row of blocks, and to align said mortar applicator over a top surface of a row of blocks during application of mortar;

means for controlling the dispensing of mortar onto the top surface of a row of blocks to facilitate selective application of mortar onto the top surface of the blocks, and to substantially limit application of mortar into the inner cavities of the blocks;

said means for controlling the dispensing of mortar facilitating the selective dispensing of mortar through the port and onto the top surface of a row of blocks, but substantially prohibiting the dispensing of mortar through said port and into the inner cavities of individual blocks.

41. The mortar applying apparatus according to claim 40 wherein said means for controlling the dispensing of mortar comprises:

a gate covering at least a portion of the mortar dispensing port;

a sensor controlling opening and closing of said gate, said sensor capable of sensing the top surface and inner cavities of blocks such that said sensor opens the gate only upon sensing of the top surface of a block.

42. The mortar applying apparatus according to claim 41 wherein said sensor comprises a dip sensor having a pivotal connection to said gate at one end, a pivotal connection to said housing at another end, and a dip portion capable of extending below the top surface of a row of blocks between the gate end and the housing end when said mortar applying apparatus is positioned on a row of blocks, whereby upon contact with the top surface of a block, said dip sensor forces the gate to open, thus permitting mortar to be dispensed from said applicator port.

43. The mortar applying apparatus according to claim 41 wherein said sensor comprises a laser which forms part of an electronic circuit controlling opening and closing of the gate.

44. The mortar applying apparatus according to claim 41 wherein said gate is spring-loaded to allow said gate to remain in a closed, non-dispensing position under the weight of mortar.

45. The mortar applying apparatus according to claim 41 wherein said housing includes a mortar distribution chamber with dividers defining a plurality of channels, said channel dividers guiding mortar into each channel.

46. The mortar applying apparatus according to claim 45 wherein said mortar distribution chamber is divided into at least three channels which define at least three mortar dispensing ports, at least two of the outer ports remaining at least partially open to the flow of mortar and substantially corresponding in size to the size of an outer region of the top surface of a row of blocks, and at least one inner port, wherein flow of mortar through said at least one inner port is controlled by the block sensor and the gate.

47. The mortar applying apparatus according to claim 40 wherein housing guide comprises at least one wheel extending from said housing to traverse a row of blocks.

48. The mortar applying apparatus according to claim 47 wherein said at least one wheel includes an outer peripheral surface and a groove positioned in said outer peripheral surface to simultaneously traverse a portion of the top surface and a portion of the side surface of a row of blocks, for increased housing stability and mortar application accuracy.

49. The mortar applying apparatus according to claim 40 wherein the distance between said mortar applicator and the top surface of a row of blocks is adjustable to allow for mortar coatings of varying thickness.

50. The mortar applying apparatus according to claim 40 wherein said housing further includes at least one handle to permit manual manipulation of said housing to, in turn, propel said mortar applying apparatus along the top surface of a row of blocks.

51. The mortar applying apparatus according to claim 40 wherein the housing further including a laser for leveling the course of the mortar applying apparatus as it dispenses mortar and traverses the top surface of a row of blocks.

52. A method for laying masonry blocks in multiple-block units comprising:

positioning the blocks, each having two opposing sides, two opposing ends, a top surface, a bottom surface, at least one aperture in said top surface, and at least one inner cavity extending into the block from said aperture, such that each block has at least one end which is adjacent to an end of at least one other block;

spacing the blocks at predetermined intervals so as to create a gap between at least a portion of each adjacent block end;

injecting mortar into the gap between at least a portion of each pair of adjacent blocks to form a mortar joint therebetween, thus forming an integral row of blocks and a multiple-block unit;

inserting at least a portion of one pair of distally spaced, cooperating and opposing major and minor gripping members into the inner cavity of at least one block of said multiple-block unit, each of said opposing major and minor gripping members having a block gripping surface and being attached to a gripper mounting bar such that at least a portion of said major and minor gripping members extend below said gripper mounting bar, each of said major gripping members being associated with a second end of a gripping arm which extends downwardly from a weight distribution beam, a first end of the gripping arm being pivotally attached to said weight distribution beam;

lifting the weight distribution beam, thus causing the exertion of a clamping force along an interior portion of said inner cavity of the blocks gripped by said major and minor gripping members to retain all of said blocks in said multiple block unit in alignment, for simultaneous raising and lowering of same;

raising the multiple block unit; and positioning the multiple block unit on a preselected location.

53. The method according to claim 52 wherein the steps of positioning the blocks such that each block has at least one end adjacent to an end of at least one other block and spacing the blocks at predetermined intervals occur substantially simultaneously.

54. The method according to claim 52 further comprising the step of tamping the multiple block unit after injecting mortar into the gap between each block end to distribute the mortar substantially uniformly into the block gaps.

55. The method according to claim 52 wherein the steps of positioning the blocks such that each block has at least one end adjacent to an end of at least one other block further includes positioning the blocks on a conveyor system to permit intermittent movement thereof.

56. The method according to claim 52 further including the step of applying mortar to the top surface of a first multiple block unit after said unit is positioned in a predetermined location to permit placement of a subsequent second multiple block unit on the top surface of the first multiple block unit.

57. The method according to claim 56 wherein mortar is selectively applied to said top surface of said first multiple block unit, while substantially limited from application into the inner cavities of said blocks.

58. The method according to claim 57 further comprising the steps of:

feeding mortar to a mortar applicator, said mortar applicator contained by a housing, said housing including a housing guide extending from said housing to allow said housing to controllably traverse said top surface of said row of blocks, and to align said mortar applicator over said top surface of said row of blocks during application of mortar;

advancing said housing and said mortar applicator over said row of blocks;

selectively dispensing mortar onto the top surface of said row of blocks to facilitate selective application of mortar to the top surface of the blocks, and to substantially limit application of mortar into the said at least one inner cavity of said at least one block through the at least one block aperture.

59. The method according to claim 58 wherein said housing guide facilitates advancement of said housing and said mortar applicator over the top surface of said multiple block unit.

60. The method according to claim 58 wherein the steps of advancement of said housing and selective application of mortar occur substantially simultaneously.

61. A system for laying masonry blocks in multiple-block units, for masonry blocks each having two opposing sides, two opposing ends, a top, a bottom and at least one inner cavity extending into the block from an aperture in the top surface, and for masonry blocks positioned upon entry to said system such that each block has at least one end which is adjacent to the end of at least one other block and such that the blocks are positioned at predetermined intervals so as to create a gap between at least a portion of each adjacent block end, said block-laying system comprising:

a mortar injection device for injecting mortar into the-gap between at least a portion of each pair of adjacent blocks, thereby forming a mortar joint therebetween and, in turn, an integral row of blocks and a multiple block unit;

a block hoist apparatus for raising and lowering blocks formed into a multiple-block unit, the block hoist apparatus configured to clamp blocks arranged in a multiple block unit through the inner cavity of at least one of the blocks such that the block hoist apparatus maintains blocks formed into a multiple block unit in alignment;

a mortar laying apparatus for selectively dispensing mortar onto the top surface of blocks which have been formed into a multiple-block unit, while substantially limiting mortar application into the inner cavity of the blocks through the block apertures;

said mortar injection device including at least one mortar dispensing chute for injecting mortar into the gap between blocks, said mortar dispensing chutes corresponding to each gap between blocks in a multiple block unit having at least three blocks;

said mortar dispensing chutes being adjustable along the length of said mortar injection device to accommodate blocks of different dimensions.

* * * * *